US009468295B2

(12) United States Patent
Lawson

(10) Patent No.: US 9,468,295 B2
(45) Date of Patent: Oct. 18, 2016

(54) ZERO-WALL CLEARANCE LINKAGE MECHANISM FOR A DUAL MOTOR LIFTING RECLINER

(71) Applicant: L & P PROPERTY MANAGEMENT COMPANY, South Gate, CA (US)

(72) Inventor: Gregory M. Lawson, Tupelo, MS (US)

(73) Assignee: L & P Property Management Company, South Gate, CA (US)

( * ) Notice: Subject to any disclaimer, the term of this patent is extended or adjusted under 35 U.S.C. 154(b) by 243 days.

(21) Appl. No.: 14/245,382

(22) Filed: Apr. 4, 2014

(65) Prior Publication Data

US 2015/0282619 A1 Oct. 8, 2015

(51) Int. Cl.

| | |
|---|---|
| ***A47C 1/0355*** | (2013.01) |
| ***A61G 5/14*** | (2006.01) |
| ***A47C 1/032*** | (2006.01) |

(52) U.S. Cl.

CPC ..... *A47C 1/0355* (2013.01); *A47C 1/032* (2013.01); *A61G 5/14* (2013.01)

(58) Field of Classification Search

CPC A47C 1/0355; A47C 1/0345; A47C 3/0255; A47C 1/035; A47C 1/032; A61G 5/14

USPC ..... 297/85 M, DIG. 10

See application file for complete search history.

(56) References Cited

U.S. PATENT DOCUMENTS

2012/0299363 A1* 11/2012 Crum ..... A47C 1/0355 297/85 M

2013/0038095 A1 2/2013 Lawson et al.

2013/0175846 A1* 7/2013 Lawson ..... A61G 5/14 297/85 M

2013/0175847 A1* 7/2013 Lawson ..... A61G 5/14 297/85 M

2014/0035336 A1 2/2014 Robertson

FOREIGN PATENT DOCUMENTS

WO 2012076857 A1 6/2012

OTHER PUBLICATIONS

International Search Report with Written Opinion dated Jun. 19, 2015 in Application No. PCT/US2015/023316, 12 pages.

* cited by examiner

*Primary Examiner* — Milton Nelson, Jr.

(74) *Attorney, Agent, or Firm* — Shook, Hardy & Bacon L.L.P.

(57) ABSTRACT

A seating unit that includes a linkage mechanism adapted to move the seating unit between closed, extended, reclined, and seat-lift positions is provided. The linkage mechanism includes a footrest assembly, a back-mounting link coupled to a seat-mounting plate, a base plate coupled to a lift-base assembly via a lift assembly, a motor tube, and two linear actuators for automating adjustment of the linkage mechanism. A first phase involves a second linear actuator rotating the motor tube angularly within a first range of degrees, causing the seat-adjustment assembly to bias the seat-mounting plate. A second phase involves the second linear actuator rotating the motor tube angularly within a second range of degrees, causing the footrest assembly to extend or retract without affecting the back-mounting link bias. A third phase involves a first linear actuator causing the lift assembly to raise and tilt the base plate directly over the lift-base assembly.

20 Claims, 10 Drawing Sheets

ZERO-WALL CLEARANCE LINKAGE MECHANISM FOR A DUAL MOTOR LIFTING RECLINER

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit, which is otherwise limited by the configurations of linkage mechanisms in the field. Additionally, the improved linkage mechanism of the present invention provides for reclining a seating unit that is positioned against a wall or placed within close proximity of other fixed objects.

Reclining and lifting seating units exist that allow a user to forwardly extend a footrest, to recline a backrest rearward relative to a seat, and to lift the seat for accommodating easy ingress and egress thereof. These existing seating units typically provide three basic positions (e.g., a standard, nonreclined closed position; an extended position; and a reclined position), and a seat-lift position as well. In the closed position, the seat resides in a generally horizontal orientation and the backrest is disposed substantially upright. Additionally, if the seating unit includes an ottoman attached with a mechanical arrangement, the mechanical arrangement is collapsed such that the ottoman is not extended. In the extended position, often referred to as a television ("TV") position, the ottoman is extended forward of the seat, and the backrest remains sufficiently upright to permit comfortable television viewing by an occupant of the seating unit. In the reclined position the backrest is pivoted rearward from the extended position into an obtuse relationship with the seat for lounging or sleeping. In the seat-lift position, the recliner mechanism is adjusted to the closed position and a lift assembly raises and tilts forward the seating unit in order to facilitate entry thereto and exit therefrom.

Several modern seating units in the industry are adapted to provide the adjustment capability described above. However, these seating units require relatively complex linkage mechanisms to afford this capability. The complex linkage assemblies limit certain design aspects when incorporating automation. In particular, the geometry of these linkage assemblies impose constraints on incorporating or mounting a plurality of motors thereto. Such constraints include the motors, during extension and/or retraction when adjusting between the positions mentioned above, interfering with crossbeams, the underlying surface, or moving parts attached to the linkage assembly. In view of the above, a more refined linkage mechanism that achieves full movement when being automatically adjusted between the closed, extended, reclined, and even seat-lift positions would fill a void in the current field of motion-upholstery technology. Accordingly, embodiments of the present invention pertain to a novel linkage mechanism that is constructed in a simple and refined arrangement in order to provide suitable function while overcoming the above-described, undesirable features inherent within the conventional complex linkage mechanisms.

BRIEF SUMMARY OF THE INVENTION

Embodiments of the present invention seek to provide a simplified lifter-recliner linkage mechanism that can be assembled to a pair of compact motors and that can be adapted to essentially any style of seating unit. In an exemplary embodiment, the compact motors in concert with the linkage mechanism can achieve full movement and sequenced adjustment of the seating unit when being automatically adjusted between the closed, extended, reclined, and seat-lift positions. The compact motors may be employed in a proficient and cost-effective manner to adjust the linkage mechanism without creating interference or other disadvantages appearing in the conventional designs that are inherent with automation thereof. The linkage mechanism may be configured with features (e.g., logic that controls the compact motors individually) that assist in sequencing the seating-unit adjustment between positions, maintaining a seat in a substantially consistent location during the seating-unit adjustment, and curing other disadvantages appearing in the conventional designs.

Generally, the lifter-recliner seating unit includes the following components: foot-support ottoman(s); a pair of base plates in substantially parallel-spaced relation; a pair of lift assemblies and at least one crossbeam spanning the lift assemblies; a lift-base assembly coupled to the lift assemblies via the lift assemblies; a pair of seat-mounting plates in substantially parallel-spaced relation; and a pair of the generally mirror-image linkage mechanisms that interconnect the base plates to the seat-mounting plates. In operation, the linkage mechanisms are adapted to move between a closed position, an extended position, and a reclined position, while the lift assemblies are adapted to move the linkage mechanisms into and out of a seat-lift position.

In one embodiment, the linkage mechanisms include a footrest assembly that extends and retracts at least one foot-support ottoman and a seat-adjustment assembly that reclines and inclines the backrest. Further, the lifter-recliner seating unit may include a first linear actuator that provides automated adjustment of the seating unit between the closed position and the seat-lift position. Typically, the first linear actuator is configured to move the lift assemblies into and out of the seat-lift position while maintaining the linkage mechanisms in the closed position and while consistently maintaining the seat-mounting plates inside a footprint of the lift-base assembly. The lifter-recliner seating may also include a second linear actuator that provides automated adjustment of the seating unit between the extended position, the reclined position, and the closed position.

In yet another embodiment, the seating unit includes the first linear actuator and the second linear actuator. The first linear actuator that provides automated adjustment of the linkage mechanisms between the closed position and the seat-lift position. Generally, the first-linear-actuator adjustment involves a third phase. The second linear actuator generally provides automated adjustment of the seating unit between the closed position, the extended position, and the reclined position. In embodiments, the second-linear-actuator adjustment is sequenced into a first phase and a second phase. In some embodiments, the first phase is sequenced with the second phase and the third phase such that the first, second, and third phases are mutually exclusive. In one instance, the first phase moves the seat-adjustment assembly between the reclined position and the extended position. In another instance, the second phase moves the footrest assembly between the extended position and the closed position. In operation, the first phase moves the pair of lift assemblies into and out of the seat-lift position while the pair of linkage mechanisms is maintained in the closed position.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
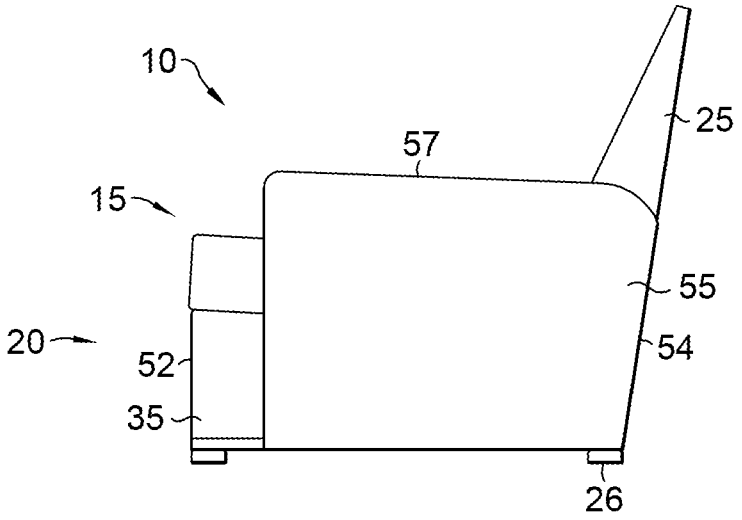
FIG. 1 is a diagrammatic lateral view of a seating unit in a closed position, in accordance with an embodiment of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

Generally, embodiments of this invention introduce technology within the motion furniture industry to improve operation and styling of a lifter-recliner-type seating unit. In embodiments, the operational improvements include: configuring linkage mechanisms of the seating unit to maintain a seat and backrest directly above the lift assembly throughout adjustment; designing the linkage mechanisms to attach to a lift-base assembly via one attachment point per side; and employing a straight tube to serve as a majority of the base plate thereby minimizing weight and material. In embodiments, the styling improvements include: attaching lift links of the lift assembly directly to the linkage mechanisms, respectively, in order to increase stability of the seating unit; and reorganizing attachment points interconnecting links comprising the linkage mechanisms, thereby allowing for such styling features as T-cushion seating. These above-listed improvements, as well as various others, will become evident within the description below and the accompanying drawings.

FIGS. 1-4 illustrate a seating unit 10. Seating unit 10 has a seat 15, a backrest 25, legs 26 (e.g., floor-support bushings or a lift-base assembly 600 that rests upon an underlying surface), at least one linkage mechanism 100, at least one lift assembly 700, a first motor assembly 300, a second motor assembly (see reference numeral 370 of FIG. 6) at least one foot-support ottoman 45, a stationary base 35 or chassis, and a pair of opposed arms 55. Stationary base 35 has a forward section 52, a rearward section 54, and is supported by the legs 26 or the lift-base assembly 600 (see FIG. 5), which vertically suspends the stationary base 35 above the underlying surface (not shown). In addition, the stationary base 35 is interconnected to the seat 15 via the linkage mechanism(s) 100 that are generally disposed between the pair of opposed arms 55 and the rearward section 54. Seat 15 remains generally fixed in location over the stationary base 35 during adjustment of the seating unit 10, or when raising or lowering the seating unit 10 into or out of a seat-lift position (see FIG. 7). In embodiments, the seat 15 and/or the backrest 25 is moveable according to the arrangement of the linkage mechanism 100 such that interference between the seat 15/backrest 25 and the opposed arms 55 is prevented throughout adjustment.

Opposed arms 55 are laterally spaced and have an arm-support surface 57 that is typically substantially horizontal. In one embodiment, the pair of opposed arms 55 are attached to the stationary base 35 via intervening members. The backrest 25 extends from the rearward section 54 of the stationary base 35 and is rotatably coupled to the linkage mechanism(s) 100, typically proximate to the arm-support surface 57. Foot-support ottoman(s) 45 are moveably supported by the linkage mechanism(s) 100. The linkage mechanism(s) 100 are arranged to articulately actuate and control movement of the seat 15, the back 25, and the ottoman(s) 45 between the positions shown in FIGS. 1-3, as more fully described below. In addition, when the linkage mechanism 100 is adjusted to the closed position (see FIG. 1), the lift assembly 700 is configured to adjust the seating unit 10 into and out of the seat-lift position (see FIG. 4).

As shown in FIGS. 1-4, the seating unit 10 is adjustable to four positions: a closed position 20, an extended position 30 (i.e., TV position), the reclined position 40, and the seat-lift position 50. FIG. 1 depicts the seating unit 10 adjusted to the closed position 20, which is a normal nonreclined sitting position with the seat 15 in a generally horizontal position and the backrest 25 generally upright and generally perpendicular to the seat 15. In one embodiment, the seat 15 is disposed in a slightly inclined orientation relative to the stationary base 35. In this embodiment, the inclined orientation may be maintained throughout adjustment of the seating unit 10 due to the novel configuration of the linkage mechanism(s) 100. Further, when adjusted to the closed position 20, the foot-support ottoman(s) 45 are positioned below the seat 15.

Figure 2:
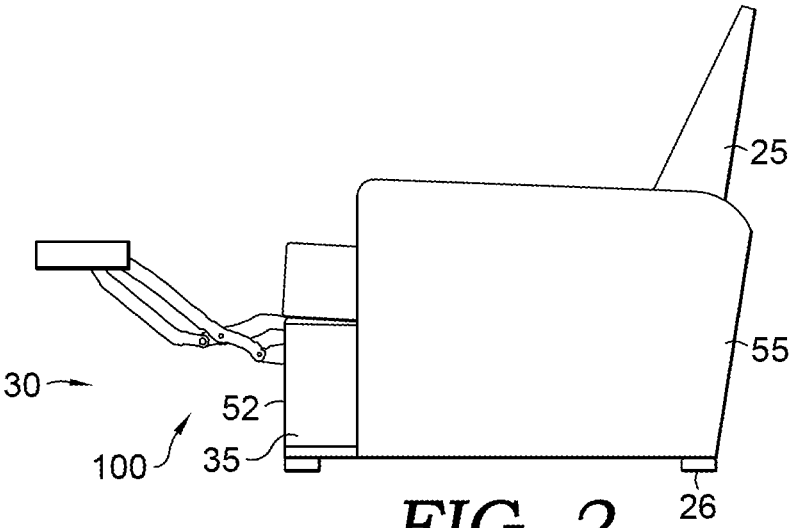
FIG. 2 is a view similar to FIG. 1, but in an extended position, in accordance with an embodiment of the present invention.

Turning to FIG. 2, the extended position 30, or TV position, will now be described. When the seating unit 10 is adjusted to the extended position 30, the foot-support ottoman(s) 45 are extended forward of the forward section 52 of the stationary base 35 and disposed in a generally horizontal orientation. However, the backrest 25 remains substantially perpendicular to the seat 15 and will not encroach an adjacent wall. Also, the seat 15 is maintained in the inclined orientation relative to the stationary base 35. Typically, the seat 15 is not translated forward, backward, downward, or upward relative to the stationary base 35. Thus, the configuration of the seating unit 10 in the extended position 30 provides an occupant an inclined TV position while providing space-saving utility. This lack of independent movement of the seat 15, with respect to the opposed arms 55, allows for a variety of styling to be incorporated into the seat 15, such as T-cushion styling.

Figure 3:
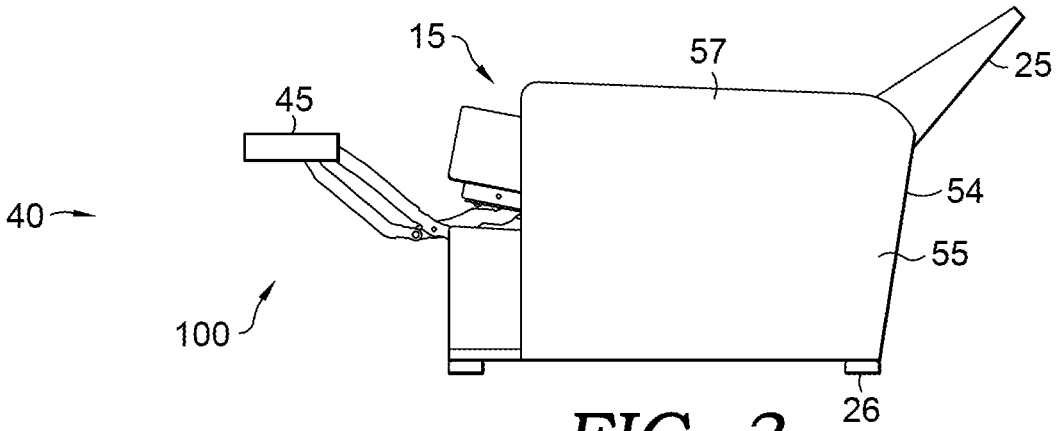
FIG. 3 is a view similar to FIG. 1, but in a reclined position, in accordance with an embodiment of the present invention.

FIG. 3 depicts the reclined position 40, in which the seating unit 10 is fully reclined. Typically, the backrest 25 is rotated rearward by the linkage mechanism 100 and biased in a rearward inclination angle. The rearward inclination angle is typically an obtuse angle in relation to the seat 15. However, the rearward inclination angle of the backrest 25 is offset by a slight-to-negligible forward and upward translation of the seat 15 as controlled by the linkage mechanism 100. This is in contrast to other reclining chairs with 3- or 4-position mechanisms, which cause their backrest to move rearward during adjustment, thereby requiring that the reclining chair be positioned a further distance from an adjacent rear wall. Generally, the mechanism thus permits positioning the seating unit 10 in closer proximity to an adjacent rear wall and other fixed objects behind the seating unit. In embodiments of the reclined position 40, the foot-support ottoman(s) 45 may be moved slightly upward, but not translated forward or rearward, from their position in the extended position 30.

Figure 4:
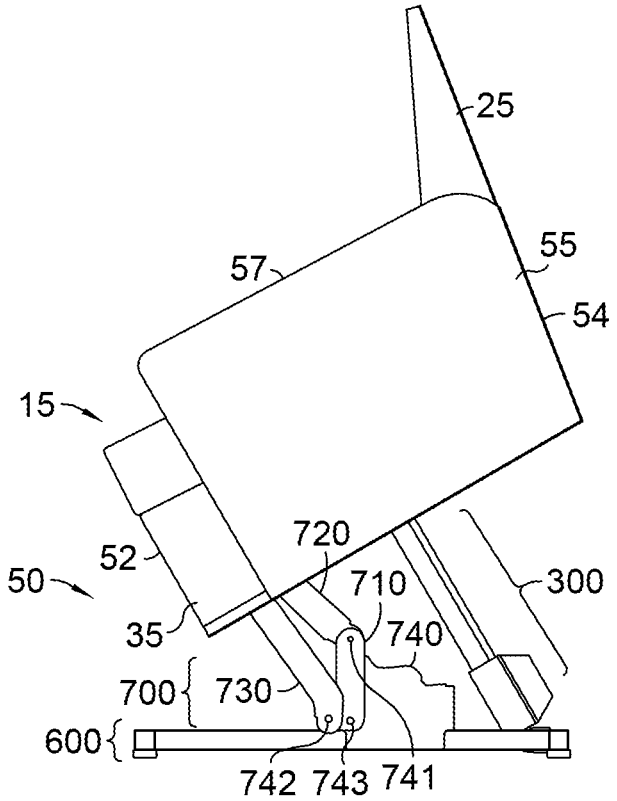
FIG. 4 is a view similar to FIG. 1, but in a seat-lift position, in accordance with an embodiment of the present invention.

Turning to FIG. 4, the seat-lift position 50, will now be described. When the seating unit 10 is adjusted to the seat-lift position 50, the linkage mechanism(s) 100 are maintained in the closed position 20 of FIG. 1, but raised upward and tilted forward to assist with an occupant's ingress to and egress from the seating unit 10. In an exemplary embodiment, the lift assemblies 700 are employed to raise and tilt the linkage mechanism(s) 100, as well as the seating-unit components attached thereto, with respect to the lift-base assembly 600. In one instance, adjustment of the lift assembly 700 may be automated through the use of a first linear actuator within the first motor assembly 300. Typically, a second linear actuator 390 within the second motor assembly 370 may be employed to adjust the linkage mechanism 100 between the closed, extended, and reclined positions as well.

In embodiments, lift links 720 and 730 of the lift assembly 700 are pivotably coupled to a riser connector plate 710 at connection points 741 and 742, respectively. The pivotable coupling of the lift links 720 and 730 at the connection points 741 and 742 may be made via rivets, which greatly reduce material cost, assembly labor time, and allow for a much greater separation of the left- and right-side lift links. This widened separation between the lift links 720 and 730 and the opposed lift links (not shown) substantially increases the stability of the seating unit 10.

Figure 12:
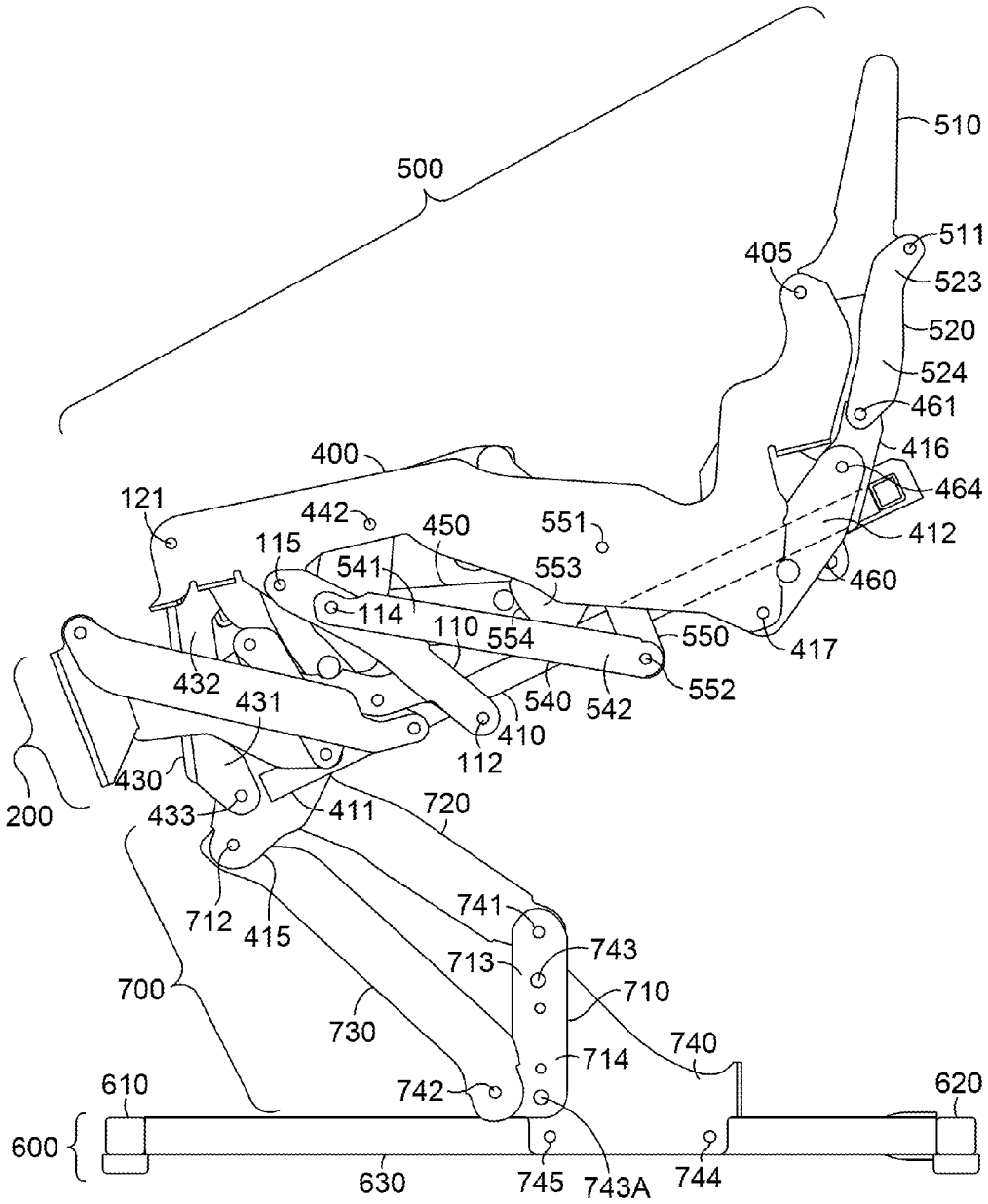
FIG. 12 is a view similar to FIG. 9, but in the seat-lift position, in accordance with an embodiment of the present invention.

Further, as best seen in FIG. 12, the links 710, 720, and 730 of the lift assembly 700 may be initially incorporated within the linkage mechanism 100, while the lift-base assembly 600 is initially assembled separately. In embodiments, the linkage mechanism 100 is mounted to the lift-base assembly 600 at connection points 743 and 743A, which fixedly attach the riser connector plate 710 of the lift assembly to a lift bracket 740 that is typically welded to the lift-base assembly 600. In this way, the connection points 743 and 743A allow for linkage mechanism 100 to be attached to the lift-base assembly 600 with only two fasteners (e.g., shoulder bolts). Thus, the assembly process of attaching the linkage mechanism 100 to the lift-base assembly 600 is simplified and can be easily performed prior to shipping on the fabrication facility or subsequent to shipping on the premise of a seating-unit manufacturer. By attaching the linkage mechanism 100 to the lift-base assembly 600 after shipping, the freight costs are reduced as the components may be packaged individually in order to minimize cargo space being utilized.

As can be seen, the lack of translation of the seat 15 during the adjustment between the closed position 20, extended position 30, reclined position 40, and the seat-lift position 50, enables the seat 15 to remain substantially in place directly over lift-base assembly 600. This lack of translation is caused by the geometry of the linkage mechanism 100. This geometry accommodates an innovative dual-motor design (e.g. see FIGS. 5-6) that allows the seating unit 10 to remain positioned directly over a perimeter of the lift-base assembly 600 (e.g., hovering over a profile established by the adjoining structural elements that form a foundation of the seating unit) through each adjustment of the seating unit 10. Specifically, as will be demonstrated later via FIGS. 9-12, the linkage mechanism 100 prevents the seat 15 from shifting rearward as the footrest assembly 200 extends. Instead, upon adjusting from the closed position 20 to the extended position 30, the seat 15 moves generally upward and slightly forward, thereby acting to recline the seating unit 10. In this way, the lifting of the seat 15 helps to balance the reclining movement of a seating-unit occupant's weight.

Moreover, this consistent lateral positioning (i.e., insignificant fore or aft movement of the seat) provides furniture manufacturers the ability to offer a full enclosure of both the linkage mechanism 100 and the lift-base assembly 600, thereby providing full protection of articulating linkages when the seating unit 10 is adjusted to the seat-lift position 50. In contrast, conventional dual-motor designs translate the seat forward or rearward during adjustment such that the seat 15 moves outside a perimeter of the lift-base assembly 600. In particular examples, these conventional designs either move their seat rearward when reclining (e.g., push-on-the-arm style chairs) or move their seat forward (e.g., traditional wall-avoiding style chairs).

Turning to FIGS. 5-12, exemplary configurations of a linkage mechanism 100 for a lifter-recliner-type seating unit 10 (hereinafter "seating unit") that is powered by two linear actuators included within the first motor assembly 300 and the second motor assembly 370, respectively, are illustrated and will now be discussed. With initial reference to FIG. 5, a perspective view of the linkage mechanism 100 in the reclined position is shown, in accordance with an embodiment of the present invention. In embodiments, the linkage mechanism 100 includes a footrest assembly 200, a seat-mounting plate 400, a base plate 410, a seat-adjustment assembly 500, the lift-base assembly 600, and the lift assembly 700. The footrest assembly 200 is comprised of a plurality of links arranged to extend and collapse the ottoman(s) (e.g., foot-support ottoman 45 of FIGS. 1-4) during adjustment of the seating unit between the extended position and the closed position, respectively. The seat-mounting plate 400 is configured to fixedly mount to the seat of the seating unit and, in conjunction with an opposed seat-mounting plate, defines a seat support surface (not shown).

Generally, the seat-adjustment assembly 500 is adapted to recline and incline the backrest of the seating unit, which is coupled to a back-mounting link 510 of the seat-adjustment assembly 500. Further, the seat-adjustment assembly 500 includes links (e.g., front motor tube bracket 360 and second motor tube bracket 470) that indirectly couple the pair of linear actuators to the base plate 410 and back-mounting link 510, respectively, thereby facilitating lifting movement of the seat 15 and backrest 25 upon selective actuation of the first and second linear actuators 340 and 390.

Further, the linkage mechanism 100 comprises a plurality of linkages that are arranged to actuate and control movement of the seating unit during adjustment between the closed, the extended, the reclined, and the seat-lift position. These linkages may be pivotably interconnected. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well known in the furniture-manufacturing industry.

In a particular example, the articulating joints (e.g., rotatable and pivotable couplings) are incorporated within the linkage mechanism 100 (e.g., rivets). This feature of providing the articulating joints within the linkage mechanism 100 minimizes repair costs associated with wear, as the more expensive welded assemblies (e.g., lift-base assembly 600) will not be exposed to wear. Generally, in nonmoving connections (e.g., connection point 743 of FIG. 4), most other fasteners are standard bolts.

Also, the shapes of the linkages and the brackets may vary as desired, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements (such as intervening elements) may also be present.

Generally, the linkage mechanism 100 guides the rotational movement of the backrest, the minimal (if any) translation of the seat, and the extension of the ottoman(s). In an exemplary configuration, these movements are controlled by a pair of essentially mirror-image linkage mechanisms (one of which is shown herein and indicated by reference numeral 100), which comprise an arrangement of pivotably interconnected linkages. The linkage mechanisms are typically disposed in opposing-facing relation about a longitudinally-extending plane that bisects the seating unit between the pair of opposed arms. As such, the ensuing discussion will focus on only one of the linkage mechanisms 100, with the content being equally applied to the other, complimentary, linkage assembly.

With continued reference to FIG. 5, the lift-base assembly 600 will now be discussed. Typically, the lift-base assembly 600 serves as a foundation that rests on a surface underlying the seating unit. The lift-base assembly 600 includes a front lateral member 610, a rear lateral member 620, a right longitudinal member 630, and a left longitudinal member (not shown). These members 610, 620, 630 may be formed from square metal tubing, or any other material used in the furniture-manufacturing industry that exhibits rigid properties. The front lateral member 610 and the rear lateral member 620 serve as crossbeams that span between and couple together the right longitudinal member 630 and the left longitudinal member. Generally, the rear lateral member 620 is oriented in substantially parallel-spaced relation to the front lateral member 610. Also, the right longitudinal member 630 is oriented in substantially parallel-spaced relation to the left longitudinal member, where the left and right longitudinal members 630 span and couple the front and rear lateral members 610 and 620. Further, the front lateral member 610 and the rear lateral member 620 are fixedly attached (e.g., welded or fastened at connection points 744 and 745) to a pair of lift brackets 740 (see FIG. 12), respectively, within the lift assemblies 700. As such, the lift-base assembly 600 extends between and fixedly attaches the lift assemblies 700 in a parallel-spaced manner.

When constructed into the lift-base assembly 600, the front and rear lateral members 610 and 620 reside in substantial perpendicular relation with the right longitudinal member 630 and opposed left longitudinal member. In its role as a foundation, the lift-base assembly 600 acts as a platform by which the lift assembly 700 may raise and tilt the seating unit with respect to the underlying surface. Further, as more fully discussed below, the first linear actuator of the first motor assembly 300 controls movement of the lift assembly 700 and is pivotably coupled to the rear lateral member 620 of the lift-base assembly 600. Even further, the left and right longitudinal members 630 and the front and rear lateral members 610 and 620 represent a perimeter or profile of a footprint of the lift-base assembly 600. During adjustment of linkage mechanism 100, the seat is consistently maintained directly over the footprint of the lift-base assembly 600, thereby reaping those benefits (e.g., enabling complete fabric coverage of the lift assembly 700 and enhancing balance of the weight of an occupant within the seating unit) more fully discussed above. In other words, the first linear actuator—providing automated adjustment of the seating unit between the closed position and the seat-lift position—is configured to move the lift assembly 700 into and out of the seat-lift position while maintaining the linkage mechanisms 100 in the closed position and while consistently maintaining the seat-mounting plates 400 inside a footprint of the lift-base assembly 600.

Figure 5:
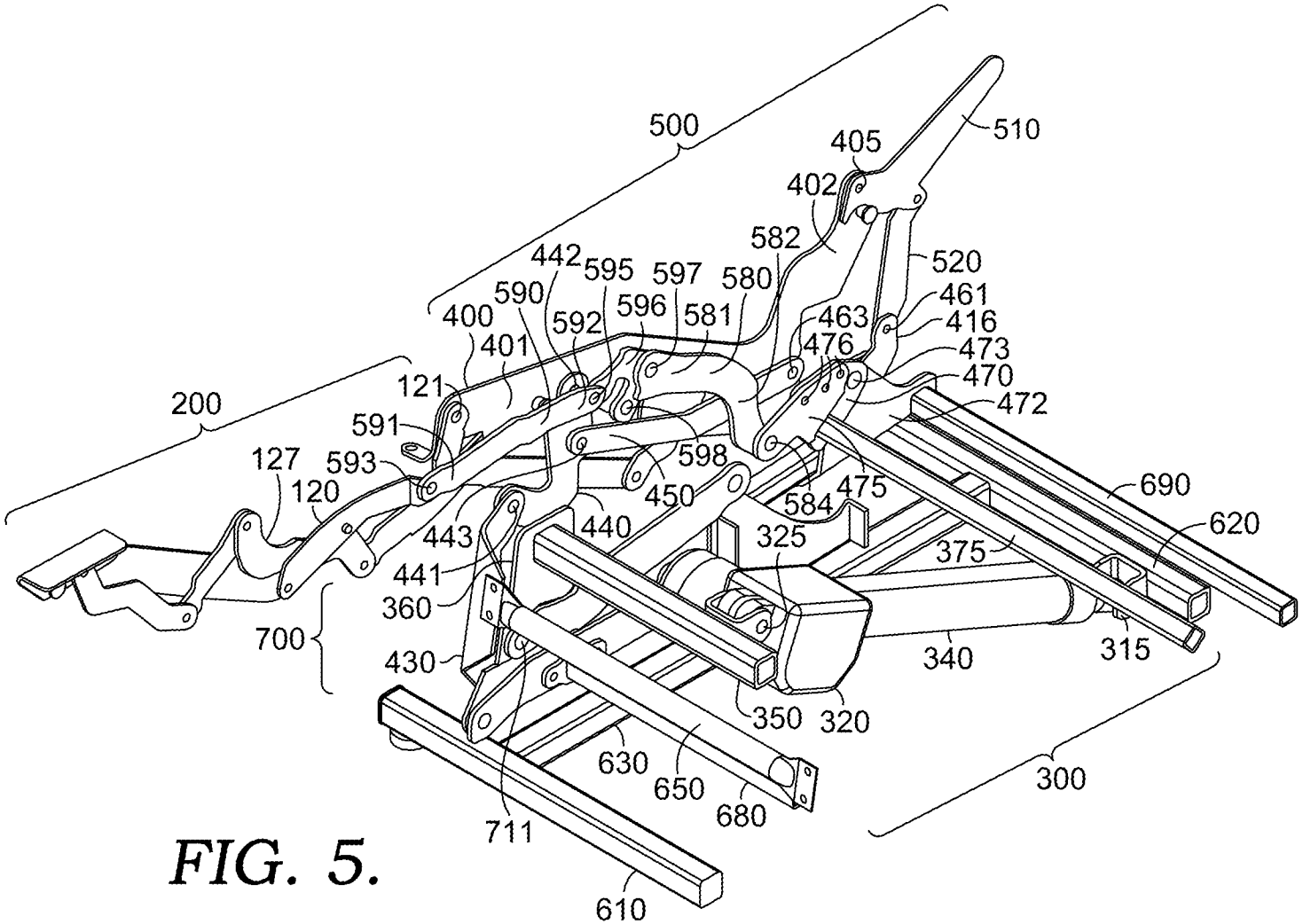
FIG. 5 is a perspective view of a linkage mechanism in the reclined position illustrating a first linear actuator for providing motorized adjustment of the seating unit, in accordance with an embodiment of the present invention.
Figure 7:
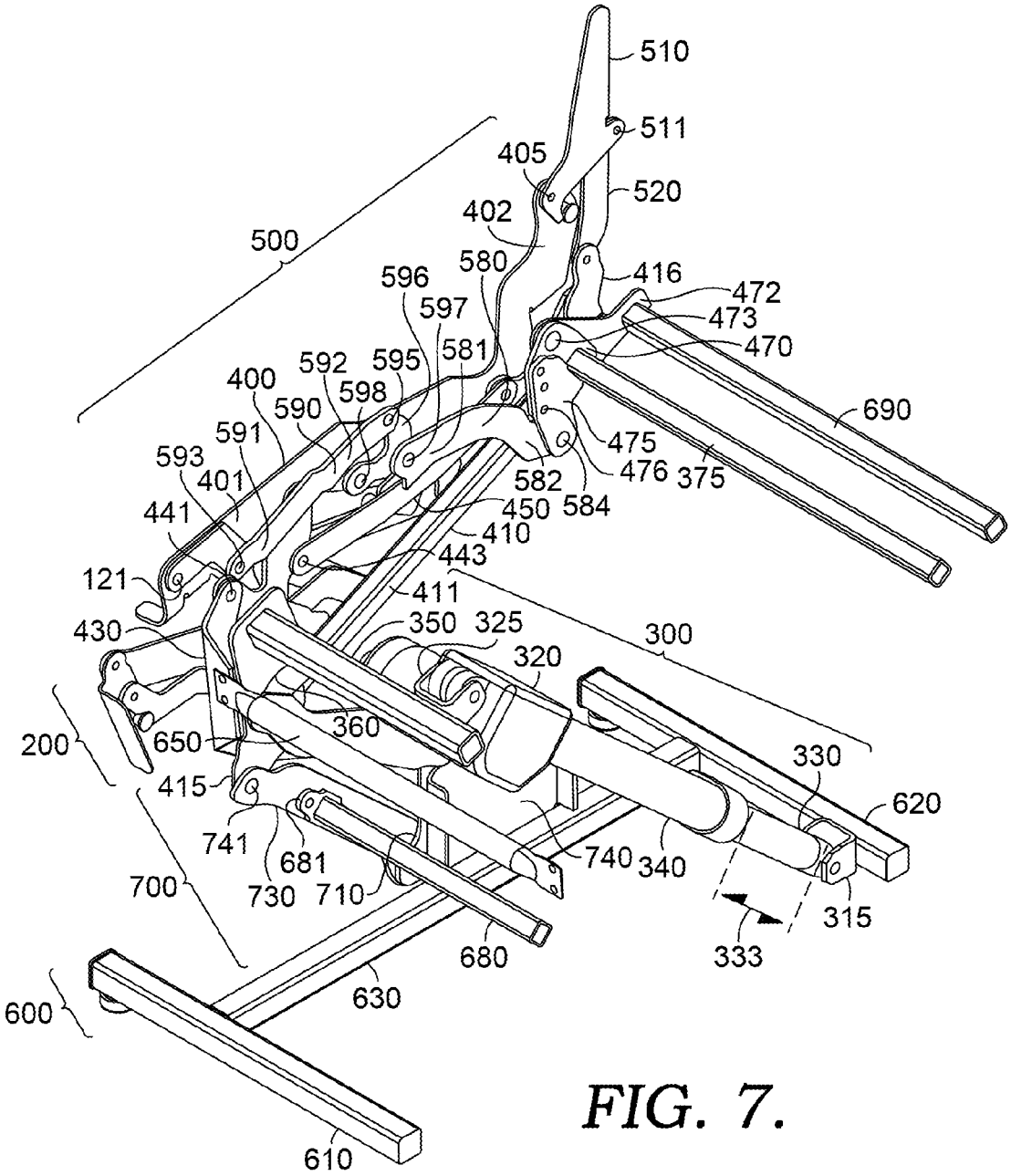
FIG. 7 is a view similar to FIG. 5, but in the seat-lift position, in accordance with an embodiment of the present invention.

Referring to FIGS. 5 and 7, an automated version of the seating unit, which utilizes a dual-motor linear actuator, is illustrated and will now be discussed via the embodiments below. In an exemplary embodiment, the linkage mechanism 100 and the lift-base assembly 600 (discussed immediately above) are inter-coupled using the first linear actuator 340 of the first motor assembly 300. Further, the first linear actuator 340 is employed to provide powered adjustment of the lift assemblies 700 into and out of the seat-lift position, while the linkage mechanism is held in the closed position. The first motor assembly 300 includes a first motor rear bracket 315, a first extendable element 330, a first motor mechanism 320, and a first motor front bracket 325. Typically, the first motor mechanism 320 (e.g., electric, hydraulic, or pneumatic cylinder head) and the first extendable element 330 (e.g., piston) are slidably connected to each other such that first extendable element 330 repositions over a third travel section (see reference numeral 333 of FIG. 8) with respect to the first motor mechanism 320 in a linear fashion. Furthermore, the first motor mechanism 320 and first extendable element 330 are slidably connected to each other, while held in position by and pivotably coupled to the rear lateral member 620 of the lift-base assembly 600 and the base plate 410 of the linkage mechanism 100, respectively. For example, as illustrated in FIG. 5, the first extendable element 330 may be pivotably coupled to a section between a pair of ends of the rear lateral member 620 via the first motor rear bracket 315.

In an exemplary configuration, the first motor mechanism 320 is protected by a housing that is pivotably coupled to the front motor tube 350 of the lift-base assembly 600 via the first motor front bracket 325. The front motor tube 350 generally spans between and couples to the linkage mechanism 100 and the opposed, counterpart, mirror-image linkage mechanism (not shown). Also, the front motor tube 350 includes a pair of ends, where each of the ends of the front motor tube 350 is fixedly coupled to a respective base plate via a fixed interface at a front motor tube bracket 360. For instance, one of the ends of the front motor tube 350 may fixedly couple with the base plate 410 via the fixed interface at the front motor tube bracket 360.

Figure 6:
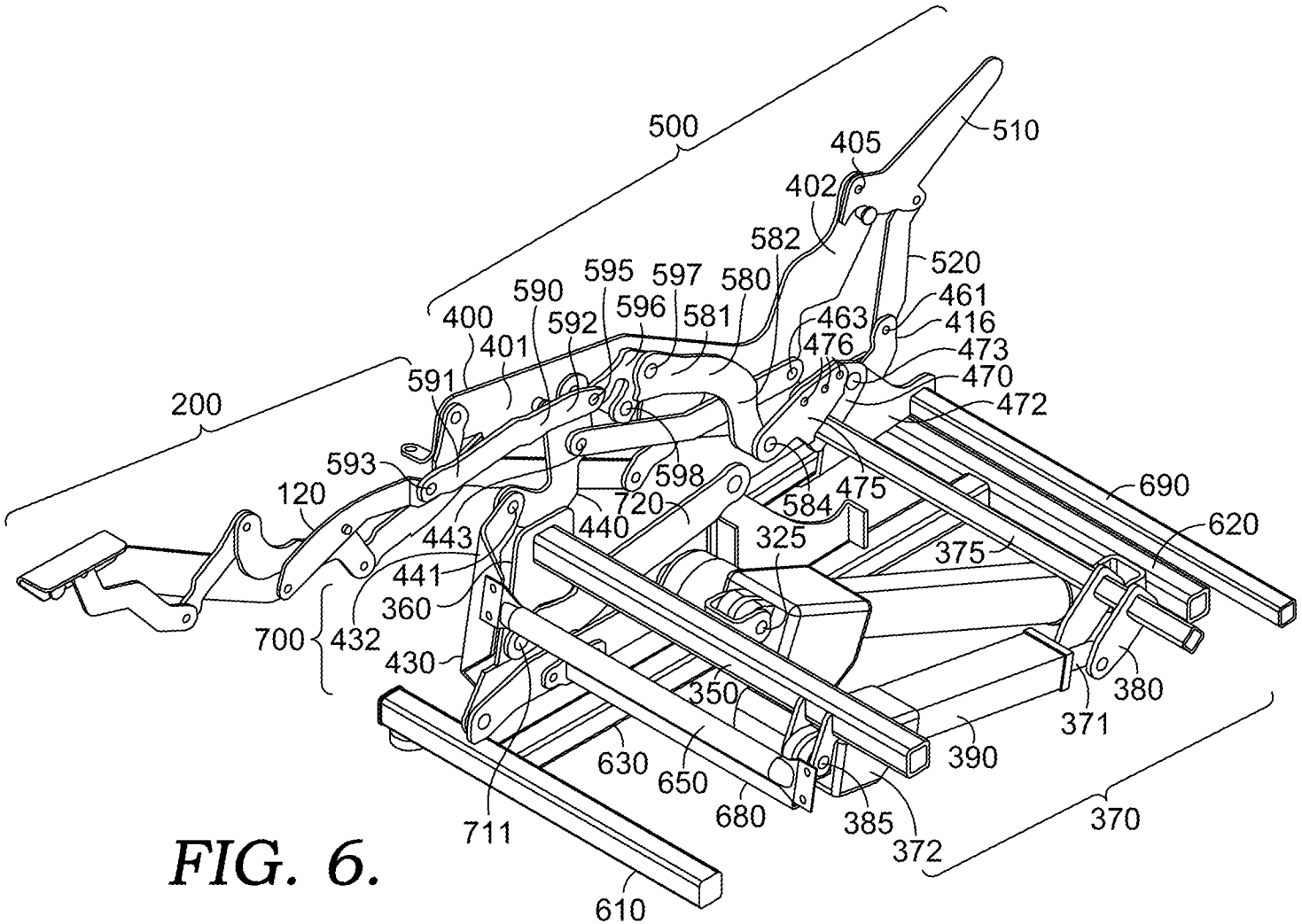
FIG. 6 is a view similar to FIG. 5, but illustrating the first and a second linear actuator for providing motorized adjustment of the seating unit, in accordance with an embodiment of the present invention.
Figure 8:
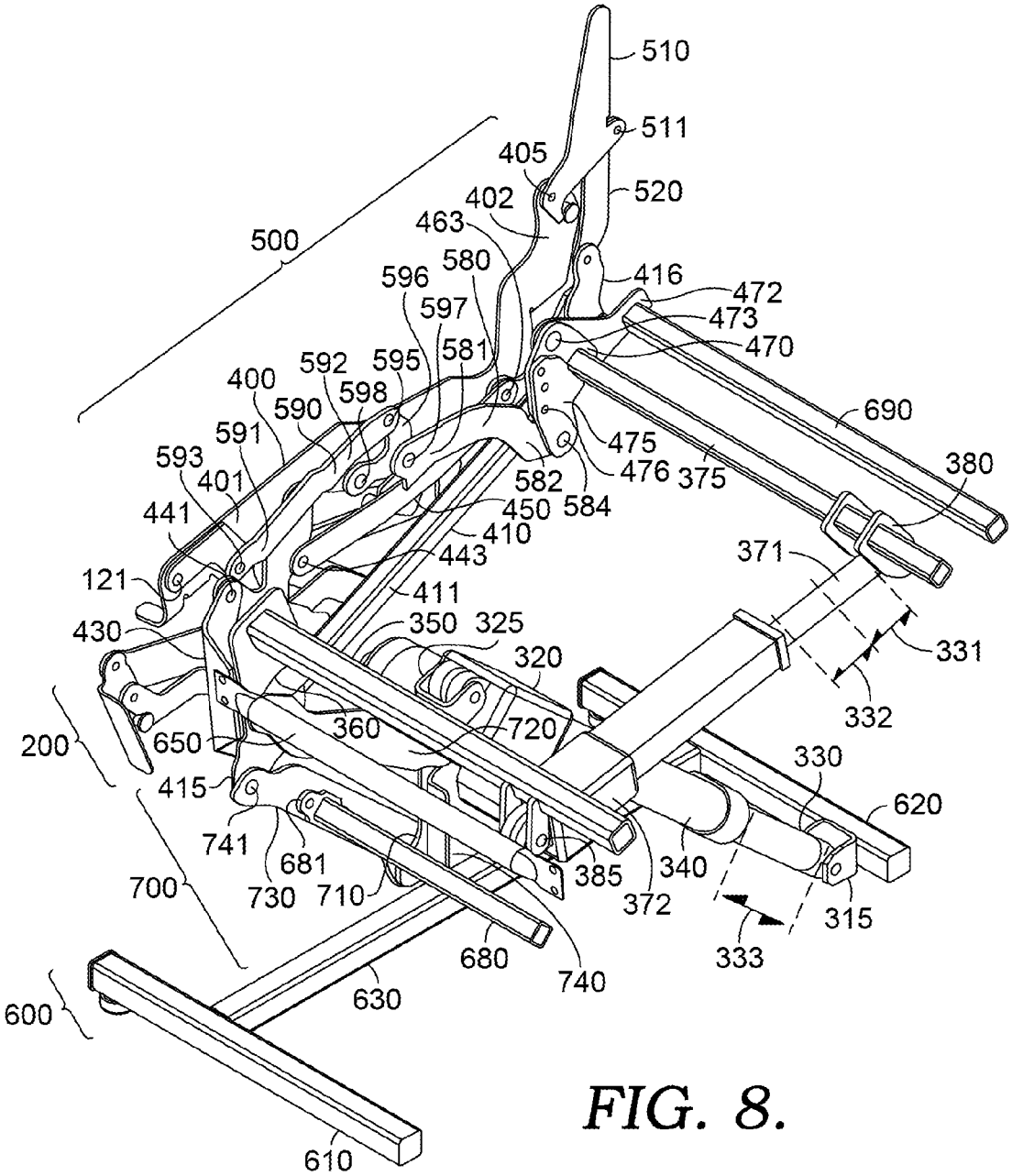
FIG. 8 is a view similar to FIG. 6, but in the seat-lift position, in accordance with an embodiment of the present invention.

Referring to FIGS. 6 and 8, a second linear actuator 390 of the duel-motor design will now be discussed via the embodiments below. In an exemplary embodiment, the linkage mechanism 100 is coupled to the second linear actuator 390 of the second motor assembly 370, which provides powered adjustment of the linkage mechanism 100 between the closed position, the extended position, and the reclined position. The second motor assembly 370 includes a second motor tube 375, a second motor rear bracket 380, a second extendable element 371, a second motor mechanism 372, and a second motor front bracket 385. Typically, the second motor mechanism 372 (e.g., electric, hydraulic, or pneumatic cylinder head) and the second extendable element 371 (e.g., piston) are slidably connected to each other such that the second extendable element 371 repositions over a first travel section and second travel section (see reference numerals 331 and 332 of FIG. 8 respectively) with respect to the second motor mechanism 372 in a linear fashion. Generally, the second extendable element 371 is pivotably coupled to the second motor tube 375 via the second motor rear bracket 380, thereby allowing for controlling rotation of the second motor tube bracket 470 and the rear lift link 460 using the second linear actuator 390. The second motor mechanism 372 is attached to the front motor tube 350 via the second motor front bracket 385, thereby holding the second motor mechanism 372 substantially stationary relative to linkage mechanism 100 while the second extendable element 371 is extended or retracted.

In one embodiment, both "linear actuators" may be configured similarly. In another embodiment, the first linear actuator 340 may be configured with a motor mechanism that linearly extends or retracts an extendable element over one or more travel sections, while the second linear actuator 390 may be configured as a third type of automated device (e.g., beta-slide bracket).

Therefore, although various different configurations of the linear actuators have been described, it should be understood and appreciated that other types of suitable devices and/or machines that automatically translate a component may be used, and that embodiments of the present invention is not limited to the piston-type actuators described herein. For instance, embodiments of the present invention contemplate systems that are configured to adjust linkages in a nonlinear path or in multiple directions, respectively. Further, embodiments of the present invention consider such features employed by the linear actuators, such as variable rates of movement that are dynamically adjusted as a function of a number of factors.

As discussed above, the front motor tube 350, the second motor tube 375, and the stabilizer tube 650 span between and couple together the linkage mechanism 100 shown in FIGS. 5-12 and its counterpart, mirror-image linkage mechanism (not shown). In embodiments, the front motor tube 350, the second motor tube 375, and the rear cross tube 690 function as respective crossbeams that may be fabricated from metal stock (e.g., formed sheet metal). Similarly, a seat-mounting plate 400, a base plate 410, and a plurality of other links that comprise the linkage mechanism 100 may be formed from metal stock, such as stamped, formed steel. However, it should be understood and appreciated that any suitable rigid or sturdy material known in the furniture-manufacturing industry may be used in place of the materials described above.

Along these lines, in an exemplary embodiment, the base plates 410 may be fabricated from a straight tube with plate-type brackets (front base plate 415, rear base plate 416, and second motor mounting plate 472) fixedly attached (e.g., welded or fastened) on each end. As illustrated in at least FIG. 7, the front base plate 415 is fixedly attached to a forward portion 411 of the base plate 410 while the rear base plate 416 and second motor mounting plate 472 are fixedly attached on opposing sides of a rearward portion 412 of the base plate 410. In particular instances, the straight tube is constructed with a generally rectangular or square cross-section. Using a straight-tube design for the majority of the base plate 410, as opposed to a flat-plate configuration, helps minimize material and weight of the base plate 410 while, at the same time, increases torsional strength along the length of the base plate 410. Further, the straight-tube design provides a simple and strong attachment means (e.g., flat weld surface or parallel walls for receiving fasteners) for receiving the second motor mounting plate 472 that mates with the rear cross tube 690, which spans and couples the pair of substantially parallel-spaced base plates. In one example, self-tapping bolts may be installed to the straight tube in a substantially vertical direction to attach the second motor mounting plate 472 to the base plate 410, thereby enhancing ease of assembly, improving consistency in the assembly positions when coupling components of the linkage mechanism 100, and for imposing minimal shearing stress on the self-tapping bolts.

In operation of the first linear actuator 340, the first extendable element 330 travels toward or away from the first motor mechanism 320 during automated adjustment. In a particular embodiment, the first motor mechanism 320 causes the first extendable element 330 to linearly traverse, or slide, under automated control. This sliding action produces a rotational and/or lateral force on the first motor front bracket 325, which, in turn, generates movement of the linkage mechanism 100 via the front motor tube 350. As more fully discussed below, the sliding action is represented by the third phase.

In operation of the second linear actuator 390, the second extendable element 371 travels toward or away from the second motor mechanism 372 during automated adjustment. In a particular embodiment, the second motor mechanism 372 causes the second extendable element 371 to linearly traverse, or slide, under automated control. This sliding action produces a rotational and/or lateral force on the second motor rear bracket 380, which, in turn, generates movement of the linkage mechanism 100 via the second motor tube 375. As more fully discussed below, the sliding action is sequenced into a first phase and a second phase.

In an exemplary embodiment, the first phase, the second phase, and the third phase are mutually exclusive. In other words, the first phase fully completes before the second phase commences, and vice versa. Likewise, the second phase fully completes before the third phase commences, and vice versa.

In a particular embodiment of the pair of linear actuators, the first extendable element 330 is operably coupled to the first motor mechanism 320 and a third travel section 333, while the second extendable element 371 is operably coupled to the second motor mechanism 372 and includes a first travel section 331 and a second travel section 332. The first extendable element 330 is linearly repositioned under automated control of the first motor mechanism 320 such that the first extendable element 330 translates within the third travel section 333 during the third phase. At other times (e.g., according to sequencing logic for separately controlling the first and second linear actuators), the second extendable element 371 is linearly repositioned under automated control of the second motor mechanism 372 such that the second extendable element 371 translates within first travel section 331 during the first phase and within the second travel section 332 during the second phase.

As illustrated in FIGS. 7 and 8, the dashed lines separating the first travel section 331, the second travel section 332, and the third travel section 333 indicate that the first and second travel sections 331 and 332 abut; however, they do not overlap. Meanwhile, the third travel section 333 is managed separately from the first and second travel sections 331 and 332. It should be realized that the precise lengths of the travel sections 331, 332, and 333 are provided for demonstrative purposes only, and that the length of the travel sections 331, 332, and 333, or ratio of the linear-actuator strokes allocated to each of the first phase, second phase, and third phase, may vary from the length or ratio depicted.

Generally, the first phase involves linearly repositioning the second extendable element 371 along the first travel section 331, which generates a first rotational movement (over a first angular range) of the second motor tube 375 with respect to the second motor tube bracket 470. The rotation of the front lift link 440 (pivotably coupled directly or indirectly to the base plate 410 via front pivot link 430) converts the rotation movement to a longitudinal thrust on the back-support link 520 via rear lift link 460 that invokes first-phase movement. This first-phase movement controls adjustment of the seat-adjustment assembly 500 between the reclined position (see FIG. 11) and the extended position (see FIG. 10). Further, during the first phase, the second extendable element 371 moves rearward with respect to the lift-base assembly 600, while the second motor mechanism 372 remains generally fixed in space.

Once the stroke of the first phase is substantially complete, the second phase may occur. Generally, the second phase involves linearly repositioning the second extendable element 371 along the second travel section 332. This repositioning within the second travel section 332 generates a second rotational movement (over a second angular range adjoining the first angular range) of the second motor tube 375 with respect to the second motor tube bracket 470, thereby invoking second-phase movement of the linkage mechanism 100. The second-phase movement controls adjustment of (extends or retracts) the footrest assembly 200 between the extended position (see FIG. 10) and the closed position (see FIG. 9). Typically, during the stroke of the second linear actuator 390 within the second phase, the second extendable element 371 again moves rearward with respect to the lift-base assembly 600, while the second motor mechanism 372 remains generally fixed in space.

In an exemplary embodiment, the first phase of movement includes the first range of degrees of angular rotation of the second motor tube 375 that does not intersect the second range of degrees of angular rotation included within the second phase of movement of the second motor tube 375. Further, the first and second phase may be sequenced into specific movements of the linkage mechanism 100. In embodiments, a weight of an occupant seated in the seating unit and/or springs interconnecting links of the seat adjustment assembly 500 may assist in creating the sequence. Accordingly, the sequence ensures that adjustment of the footrest assembly 200 between the closed and extended positions is not interrupted by an adjustment of the backrest (attached to the back-mounting link 510), and vice versa. In other embodiments, as depicted in FIGS. 9-12, sequencing may be governed by logic integrated within a computing device, processor, or processing unit, where the logic is provided to control the sequenced adjustment of the seating unit, thereby segregating those linkage articulations assigned to the first phase of movement from the linkage articulations assigned to the second phase of movement. In one embodiment, both the first linear actuator 340 and the second linear actuator 390 are controlled using a two-button system. In this two-button system, the logic allows a continuous motion from a lifted position, to closed, to extended, to fully-reclined using one button. The logic allows the other button to instruct both linear actuators to be controlled to move continuously from fully-reclined, to extended, to closed, to lifted positions. In this manner, the first and second linear actuators 340 and 390 operate as if they are one.

Once a stroke of the second phase is complete, the third phase can occur. During the third phase, the first motor mechanism 320 linearly repositions the first extendable element 330 along the third travel section 333, while the first motor mechanism 320 remains generally in fixed space, with respect to the rear lateral member 620 of the lift base assembly 600. This repositioning of the first extendable element 330 along the third travel section 333 creates a forward and upward lateral thrust at the front motor tube 350 while the pair of linkage mechanisms 100 is maintained in the closed position by the sequence element 420 being in contact and/or physical proximity with a contact edge 554 of a forward portion 553 of the sequence cam 550. In an embodiment, the pair of linkage mechanisms 100 is maintained in the closed position by the footrest drive link 590 held in a rearward position by the second motor assembly 370.

Consequently, the forward and upward lateral thrust at the front motor tube 350 invokes adjustment of the lift assemblies 700 into or out of the seat-lift position (see FIG. 12) while maintaining the pair of linkage mechanisms 100 in the closed position. That is, the stroke of the third phase raises and tilts forward the linkage mechanism 100, with respect to the lift-base assembly 600, thus, adjusting the lift assembly 700 between a collapsed configuration and an expanded seat-lift position that facilitates ingress and egress to the seating unit. As mentioned above, the raise and forward tilt of the linkage mechanism 100 during the third-phase movement does not translate fore or aft the seat with respect to the lift-base assembly 600, thus, maintaining the seat directly over a perimeter or profile formed by the members of the lift-base assembly 600 on the underlying surface.

In one instance, the first linear actuator 340 and/or the second linear actuator 390 is embodied as electrically powered linear actuator(s). In this instance, the electrically powered linear actuator(s) are controlled by a hand-operated controller that provides instructions to the logic. The logic processes the instructions and sends appropriate commands to the respective linear actuator(s) based on one or more of the following parameters: a current position of the linkage mechanism 100; whether a phase of movement is currently in progress or partially complete; whether concurrent phases of movement are allowed (e.g., footrest assembly 200 extension while backrest reclines); or a predefined ordering of the phases of movement that enforces consecutive positional adjustment.

Although various different parameters of that may be employed by the logic have been described, it should be understood and appreciated that other types of suitable configuration settings and/or rules (affecting how instructions initiated by a user-initiated actuation of the hand-operated controller are interpreted) may be utilized consistently or intermittently by the logic, and that embodiments of the present invention are not limited to the specific examples of parameters described herein. In one instance, embodiments of the present invention contemplate logic that is configured to perform the following steps: receive a request to lift the seating unit into the seat-lift position; recognize that the second phase of movement is uncompleted; command the second linear actuator 390 to fully retract the footrest assembly 200; and commence the third phase of movement by commanding the first linear actuator 340 to raise the lift assembly 700.

Although a particular configuration of the combination of the first linear actuator 340 and the second linear actuator 390 has been described, it should be understood and appreciated that other types of suitable devices that provide sequenced adjustment may be used, and that embodiments of the present invention are not limited to the linear actuators described herein. For instance, the combination of the first motor mechanism 320 and the first extendable element 330 may be embodied as a telescoping apparatus that extends and retracts in a sequenced manner.

Advantageously, the dual-motor lift mechanism (i.e., innovative interaction of the pair of linear actuators with the linkage mechanism 100) in embodiments of the present invention allows for a seating-unit manufacturer to employ various styling features to the linkage mechanism 100 (e.g., T-cushion style seat) that are not possible in a push-on-the-arm style mechanism utilized by conventional lifter recliners. Further, the dual-motor lift mechanism provides the benefits of reduced wall clearance. Yet, as discussed more fully below, the total cost for fabricating the linkages, assembling the linkages, and shipping the assemblies of the dual-motor lift mechanism is competitive or below conventional lifter recliners.

Turning to FIGS. 9-12, the components of the linkage mechanism 100 will now be discussed in detail. As discussed above, the linkage mechanism 100, which is raised and lowered by the lift assembly 700 (discussed below), includes the footrest assembly 200, the seat-mounting plate 400, the base plate 410, and the seat-adjustment assembly 500. The footrest assembly 200 includes a rear ottoman link 110, a front ottoman link 120, a first midway ottoman link 127, a second midway ottoman link 128, a lower ottoman link 130, an upper ottoman link 140, and a footrest bracket 170. The rear ottoman link 110 is rotatably coupled to both a forward portion 401 of the seat-mounting plate 400 at pivot 115 and the first midway ottoman link 127 at pivot 112. The rear ottoman link 110 is also pivotably coupled to the cam control link 540 at pivot 114.

Referring to FIG. 5, the front ottoman link 120 is pivotably coupled to a front end 591 of a footrest drive link 590 of the seat-adjustment assembly 500 at pivot 593. The footrest drive link 590 includes the front end 591 and a back end 592. The back end 592 of the footrest drive link 590 is pivotably coupled to the footrest bellcrank 596 at pivot 595. The footrest bellcrank 596 is pivotably coupled to a front end 581 of a footrest drive control link 580 at pivot 597. A back end 582 of the footrest drive control link 580 is pivotably coupled to a second motor connector link 475 at pivot 584. The second motor connector link 475 is fixedly attached to the second motor tube bracket 470 at connection points 476. The second motor tube bracket 470 is fixedly attached to one of the ends of the second motor tube 375. The second motor tube bracket 470 is responsible for securing the second motor tube 375 in a substantially perpendicular orientation such that the second motor tube 375 extends from the second motor mounting plate 472 in an inward manner to reside below the seat as depicted in FIG. 5. Also, front ottoman link 120 may include a front stop element (not shown) fixedly attached at a mid-section thereof that functions to resist continued extension of the footrest assembly 200 when the front stop element contacts a side of the first midway ottoman link 127.

In operation, during adjustment of the seating unit between the extended position and the closed position, the second linear actuator 390 causes the second motor tube 375 to rotate upon linearly repositioning the second extendable element 371 over the second travel section 332. The rotation of the second motor tube 375 rotates the second motor tube bracket 470 rearward (e.g., counter clockwise with respect to FIG. 5). This rotation of the second motor tube bracket 470 generates a rearward and downward longitudinal thrust of the footrest drive control link 580, via the interaction at the pivot 584. The rearward and downward longitudinal thrust of the footrest drive control link 580 rotates the footrest bellcrank 596 rearward about a rotatable interface 598 with seat-mounting plate 400. This rotation of footrest bellcrank 596 generates a rearward lateral thrust on footrest drive link 590, via the interaction at pivot 595 that acts on the pivot 593 of the front ottoman link 120. The rearward lateral thrust acting on the pivot 593 pulls inward on the front ottoman link 120 causing the front ottoman link 120 to rotate at the pivot 121 in a direction towards the seat-mounting plate 400 (e.g., counterclockwise with respect to FIG. 5) and, consequently, retracts the footrest assembly 200. Thus, in operation, the second rotational movement of second motor tube 375 directly affects the extended or collapsed configuration of the footrest assembly via the articulating interaction of the footrest drive link 590 and the second motor tube bracket 470.

Figure 9:
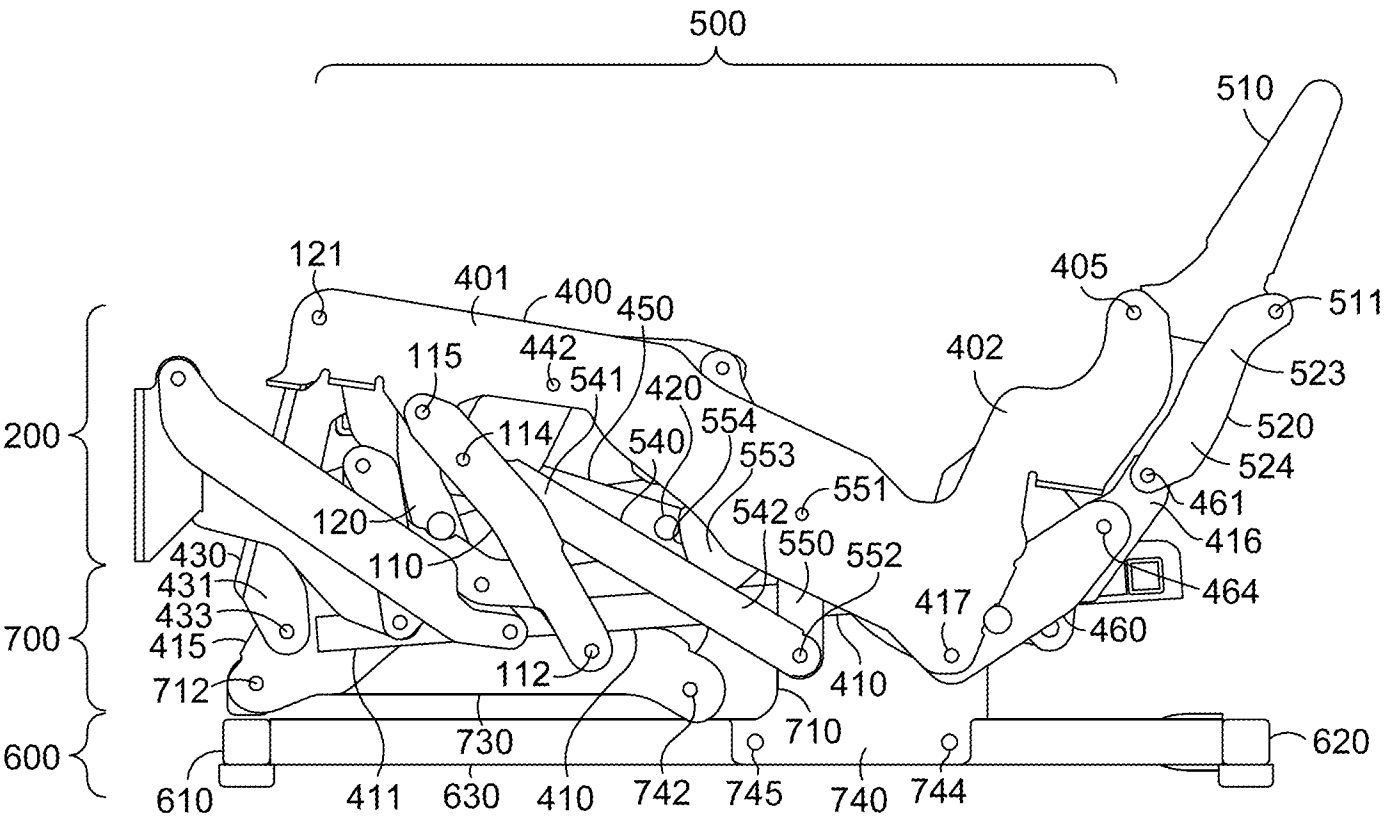
FIG. 9 is a diagrammatic lateral view of the linkage mechanism in the closed position from a vantage point external to the seating unit, in accordance with an embodiment of the present invention.
Figure 10:
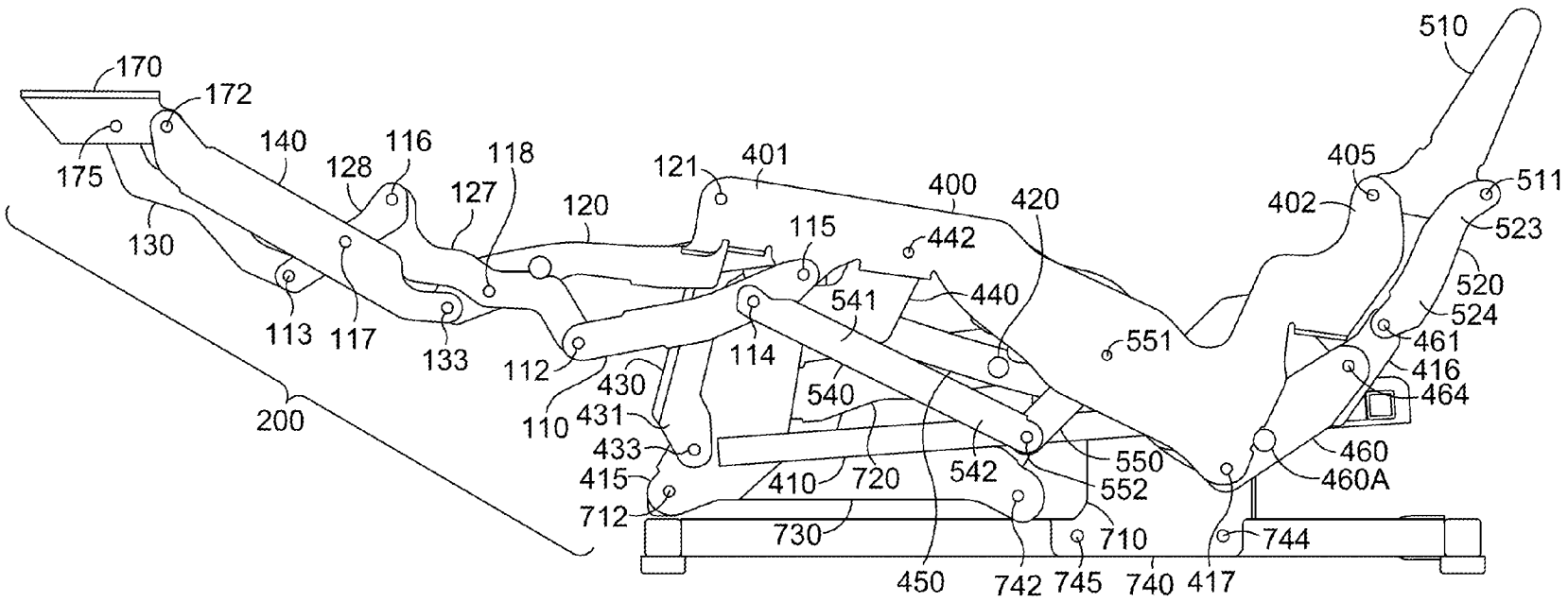
FIG. 10 is a view similar to FIG. 9, but in the extended position, in accordance with an embodiment of the present invention.

Returning to the footrest assembly 200, in embodiments, the front ottoman link 120 is rotatably coupled to the forward portion 401 of the seat-mounting plate 400 at pivot 121 and is pivotably coupled to the upper ottoman link 140 at pivot 133. In embodiments, the pivot 121 of the front ottoman link 120 is slightly forward of the pivot 115 of the rear ottoman link 110. Further, as shown in FIG. 10, the rear ottoman link 110 is pivotably coupled to a front end 541 of a cam control link 540 at pivot 114. Interaction between the cam control link 540 and a sequence cam 550 enables mutually exclusive sequencing between the first phase and the second phase. For example, during the adjustment in the second phase (i.e., adjustment between the closed and extended positions), a moment of rotation transferred by the second linear actuator 390 to the second motor tube bracket 470, via the second motor tube 375, causes the upper footrest drive link 590 to exert a directional force on the front ottoman link 120 that either extends the footrest assembly 200 to the extended position or collapses the footrest assembly 200 to the closed position. During the second phase of movement, as illustrated in FIGS. 9 and 10, the extension of the footrest assembly 200 pulls forward and upward on the cam control link 540 via pivot 114. This forward and upward pulling action creates a directional force at pivot 552, which pivotably couples a rear end 542 of the cam control link 540 to the sequence cam 550. This directional force causes the sequencing cam 550 to rotate (e.g., clockwise with respect to FIGS. 9 and 10) about pivot 551, which rotatably couples the sequencing cam 550 to a mid-section of seat-mounting plate 400. This rotation about the pivot 551 biases the sequencing cam 550 upward (see FIG. 10), such that a contact edge 554 of a forward portion 553 of the sequence cam 550 is not in contact and/or physical proximity with a sequence element 420, or biases the sequence cam 550 downward (see FIG. 9), such that the contact edge 554 is in contact or physical proximity with the sequencing element 420 extending from a connector link 450.

Further, with reference to the footrest assembly 200, the first midway ottoman link 127 is pivotably coupled at one end to the rear ottoman link 110 at pivot 112 and on the opposing end to the second midway ottoman link 128 at pivot 116. At a mid-section, the first midway ottoman link 127 may be pivotably coupled to front ottoman link 120 at pivot 118. The second midway ottoman link 128 is pivotably coupled at the other end to the lower ottoman link 130 at pivot 113. At a mid-section, the second midway ottoman link 128 may be pivotably coupled to the upper ottoman link 140 at pivot 117. The lower ottoman link 130 is further pivotably coupled to the footrest bracket 170 at pivot 175. The upper ottoman link 140 is pivotably coupled on one end to the front ottoman link 120 at pivot 133 and at the mid-section to the second midway ottoman link 128 at pivot 117. At an opposite end, the upper ottoman link 140 is pivotably coupled to the footrest bracket 170 at pivot 172. In embodiments, the footrest bracket 170 is designed to attach to ottoman(s), such as the foot-support ottoman 45 of FIG. 3. In a specific instance, as shown in FIG. 2, the footrest bracket 170 supports ottoman(s) in a substantially horizontal disposition when the footrest assembly 200 is fully extended upon completion of the second phase of movement.

Figure 11:
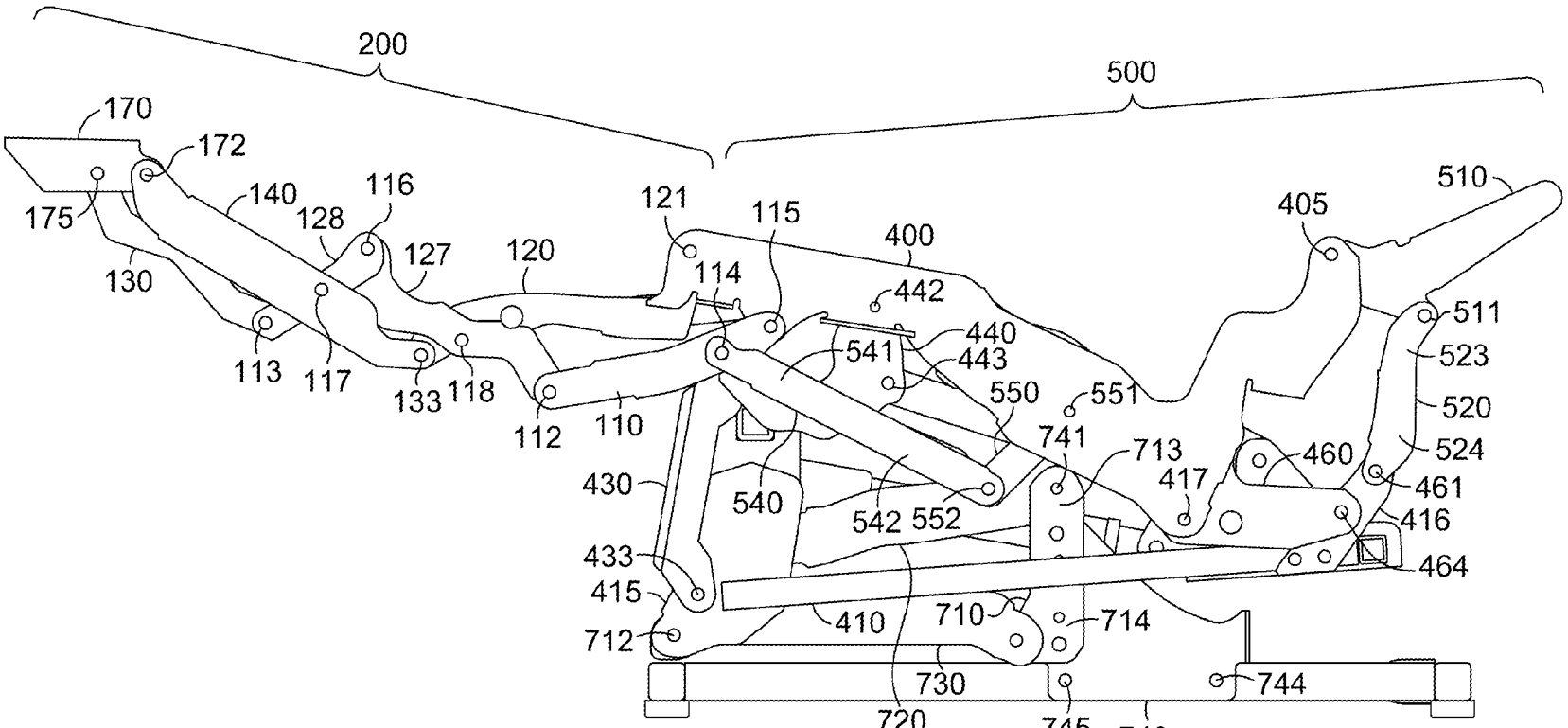
FIG. 11 is a view similar to FIG. 9, but in the reclined position, in accordance with an embodiment of the present invention.

Turning to FIGS. 8, 10 and 11, the seat-adjustment assembly 500, which reclines and inclines the backrest, will now be discussed. In embodiments, the seat-adjustment assembly 500 includes a front pivot link 430, a front lift link 440, a connector link 450, a rear lift link 460, a second motor tube bracket 470 for attaching to the second motor tube 375, a second motor mounting plate 472, a second motor connector link 475, the cam control link 540, the sequencing cam 550, a back-mounting link 510, a back-support link 520, a footrest drive control link 580, the footrest drive link 590, and the footrest bellcrank 596. Initially, the back-mounting link 510 is rotatably coupled directly or indirectly to a rearward portion 402 of the seat-mounting plate 400 at pivot 405. In instances, the back-mounting link 510 may be configured to support a backrest of the seating unit, such as the backrest 25 of FIG. 1. The back-support link 520 includes an upper end 523 and a lower end 524. The upper end 523 of the back-support link 520 is pivotably coupled to the back-mounting link 510 at pivot 511. At the lower end 524, back-support link 520 is pivotably coupled to the rear base plate 416 at pivot 461.

The rear lift link 460 is pivotably coupled directly or indirectly to the rear base plate 416 or a rearward portion 412 of the base plate 410 at pivot 464. Also, the rear lift link 460 is pivotably coupled to the connector link 450 at pivot 463. The rear end of the connector link 450 is pivotably coupled with the rear lift link 460 at pivot 463.

As illustrated in FIGS. 5 and 10, the front lift link 440 is rotatably coupled to the forward portion 401 of the seat-mounting plate 400 at pivot 442. Further, the front lift link 440 is pivotably coupled to the front end 451 of the connector link 450 at the pivot 443 while the front pivot link 430 is pivotably coupled to an upper end 432 of the front lift link 440 at pivot 441. A lower end 431 of the front pivot link 430 is pivotably coupled to the front base plate 415 or the forward portion 411 of the base plate 410 at pivot 433. That is, as discussed above, the base plate 410 may be formed of a single member (e.g., square straight tube) or may be composed of a plurality of formed plates.

Turning now to FIGS. 9 and 10, the cam control link 540, the sequence cam 550, and the sequence element 420 will now be discussed. The cam control link 540 includes a front end 541 and a rear end 542. The front end 541 of the cam control link 540 is pivotably coupled with the rear ottoman link 110 at pivot 114. The rear end 542 of the cam control link 540 is pivotably coupled with the sequence cam 550 at pivot 552. The sequence cam 550 is rotatably coupled to the seat-mounting plate at pivot 551. In particular, pivot 551 is located in a mid-section of the sequence cam 550, while a contact edge 554 is located on a segment of an exterior surface of a forward portion 553 of the sequence cam 550.

In embodiments, the sequence element 420 is configured as a welded bushing, a grommet, a cylindrically shaped element, a fastener (e.g., bolt or rivet), or any other rigid component that effortlessly rides or travels along a face of the contact edge 554. Generally, the sequence element 420 is fixedly attached to a mid-section of the connector link 450. In one instance, the sequence element 420 extends at a substantially perpendicular, outward direction from an exterior side of the connector link 450. In operation, during the first phase of movement of the seating unit, the contact edge 554 of the sequence cam 550 is removed from being adjacent to the sequence element 420, thereby allowing the seat adjustment assembly 500 to recline the back-mounting link 510 and, in turn, the backrest.

During the second phase of movement, the contact edge 554 of the sequence cam 550 is rotated about the pivot 551 (e.g., counterclockwise with respect to FIGS. 9 and 10) to reside adjacent to the sequence element 420. That is, adjustment of the footrest assembly 200 between the closed position (see FIG. 9) and extended position (see FIG. 10) may, in turn, articulably actuate the cam control link 540 laterally. This lateral actuation resulting from collapsing the footrest assembly 200 (i.e., rotating the front ottoman link 120 inward about the pivot 121) causes the sequence cam 550 to rotate about the pivot 551 such that contact edge 554 moves downward to face and, potentially, engage the sequence element 420. Consequently, the rotation of the sequence cam 550 changes a relative position of the sequence element 420 with respect to the contact edge 554.

This obstruction formed by the contact edge 554 of the sequence cam 550 residing adjacent to the sequence element 420 impedes forward translational movement of the seat-mounting plate 400 (coupled directly to the sequence cam 550 at the pivot 551) with respect to the base plate 410 (coupled to the sequence element 420 via the rear lift link 460 and the connector link 450). Impeding translational movement of the seat-mounting plate 400 with respect to the base plate 410, in effect, physically prevents the seat-adjustment assembly 500 from reclining the back-mounting link 510 while, at the same time, allows the footrest assembly 200 to extends or collapse the foot-support ottoman(s). That is, when the seating unit is adjusted to the closed position (see FIG. 9), the interaction between the sequence element 420 and the contact edge 554 of the sequence cam 550 prevents direct adjustment of the seating unit to the reclined position (see FIG. 11). However, when the contact edge 554 is adjacent to the sequence cam 550, the seating unit may be adjusted to the extended position (see FIG. 10).

Upon adjusting the seating unit to the extended position, the extension of the footrest assembly 200 causes the cam control link 540 to actuate forward in a lateral manner. This forward lateral actuation resulting from extending the footrest assembly 200 (i.e., rotating the front ottoman link 120 outward about the pivot 121) causes the sequence cam 550 to rotate about the pivot 551 such that contact edge 554 moves upward to face away from the sequence element 420. Consequently, the rotation of the sequence cam 550 removes the impendence that formerly prevented the seat-mounting plate 400 from translating with respect to the base plate 410 and, thus, allows for second-phase movement of the seat-adjustment assembly 500.

Accordingly, the sequencing described above ensures that adjustment of the footrest assembly 200 between the closed and extended positions is not interrupted by rotational biasing of the backrest, or vice versa. In other embodiments, the weight of the occupant of the seating unit and/or springs interconnecting links of the seat-adjustment assembly 500 assist in creating or enhancing the sequencing.

With reference to FIGS. 7 and 12, the lift assembly 700 will now be discussed. The lift assembly 700 includes the riser connector plate 710, an upper lift link 720, a lower lift link 730, and the lift bracket 740. The lift assembly 700 is fixedly attached to a mirror-image lift assembly (not shown) via a front cross tube 680, where one end of the front cross tube 680 may be fixedly attached to the lower lift link 730 directly or via intervening hardware (e.g., bracket 681). As discussed more fully above, the rear cross tube 690 spans and couples the base plate 410 with a complimentary base plate on the mirror-image linkage mechanism (not shown). In embodiments, the front cross tube 680 and the rear cross tube 690 may be formed from square metal tubing and may function as a set of crossbeams that rigidly secure the right linkage mechanism 100 and the left mirror-image linkage mechanism in parallel-spaced relation.

In embodiments, the lift assembly 700 (shown) is fixedly attached to the right longitudinal member 630 of the lift-base assembly 600 via the lift bracket 740 at connection points 744 and 745, while the mirror-image lift assembly (not shown) is fixedly attached to the left longitudinal member (not shown). Additionally, the riser connector plate 710 is fixedly attached to the lift bracket 740 via the connection points 743 and 743A. As discussed more fully above, the connection points 743 and 743A allow for mounting the linkage mechanism 100 to the lift-base assembly 600 with only two fasteners (e.g., shoulder bolts), thus, simplifying the assembly process of attaching the linkage mechanism 100 to the lift-base assembly 600 such that assembly may be easily performed subsequent to shipping on the premise of a seating-unit manufacturer.

Turning to FIG. 12, the internal connections of the lift assembly 700 will now be discussed. In embodiments, the riser connector plate 710 is fixedly attached to a respective longitudinal member of the lift-base assembly 600 via the lift bracket 740 at connection points 743 and 743A. Also, the riser connector plate 710 includes an upper end 713 and a lower end 714. The upper lift link 720 is pivotably coupled at one end to the front base plate 415, or forward portion 411 of the base plate 410, at pivot 711. The upper lift link 720 is also rotatably coupled at another end to the upper end 713 of the riser connector plate 710 at pivot 741. The lower lift link 730 is pivotably coupled at one end to the front base plate 415, or forward portion 411 of the base plate 410, at pivot 712. In embodiments, the pivot 711 is above and proximate to the pivot 712, with respect to lift base assembly 600. The lower lift link 730 is rotatably coupled at another end to the lower end 714 of the riser connector plate 710 at pivot 742.

In operation, the lift links 720 and 730 are configured to swing in a generally parallel-spaced relation when the linear actuator adjusts the seating unit into and out of the seat-lift position. Further, the configuration of the lift links 720 and 730 allow the base plate 410 to move in a path that is upward and tilted forward when adjusting to the seat-lift position of FIG. 12. As discussed above, movement into and out of the seat-lift position occurs in the third phase of the linear-actuator stroke in which the first extendable element 330 is linearly repositioned within the third travel section 333.

Generally, with reference to FIG. 9, the lift assembly 700 is designed such that there exists a relatively small amount of contact area between linkage mechanism 100 and the lift-base assembly 600. In particular embodiments, the entire contact area includes a forward region and a rearward region. The forward region is located along the front lateral member 610 where the front base plate 415 and/or an edge of the lower lift link 730 meets an upper surface of the front lateral member 610 when the seating unit is not adjusted to the seat-lift position. The rearward region is located at a lower end of the lift bracket 740, which is welded to the lift-base assembly 600. The rearward region of the contact area is above the frame comprising the lift-base assembly 600, thereby greatly minimizing any potential for a rear pinch point as the seating unit lowers downward to the closed position. By removing positional for the rear pinch point, harm to fingers, pets, or power cables to the linear actuators are avoided.

The operation of the seat-adjustment assembly 500 will now be discussed with reference to FIGS. 10 and 11. Initially, an occupant of the seating unit may invoke an adjustment from the reclined position (FIG. 11) to the extended position (FIG. 10) in an effort to sit upright for viewing television. In an exemplary embodiment, the occupant may invoke an actuation at a hand-operated controller that sends a control signal with instructions to a processor that hosts logic. The logic may interpret the instructions to incline the backrest and, if the sequencing parameters allow, send a command to the second linear actuator 390 to invoke movement in the first phase. As discussed above, the second linear actuator 390 may move in a sequenced manner, which may be enforced by a weight of the occupant and/or a configuration of the sequence cam 550 with respect to the sequence element 420. Typically, the movement of the second linear actuator 390 is sequenced in coordination with the first linear actuator 340 into three substantially independent strokes: the first phase (adjusting between the reclined and extended positions), the second phase (adjusting between the extended and closed positions), and the third phase (adjusting into and out of the seat-lift position (see FIG. 12) while the linkage mechanism 100 resides in the closed position).

Upon receiving the control signal from the hand-operated controller when the linkage mechanism 100 resides in the reclined position, the second linear actuator 390 carries out a stroke in the first phase. That is, with reference to FIG. 6, the second linear actuator 390 linearly repositions the second extendable element 371 rearward along the first travel section 331 (see FIG. 8) with respect to the lift-base assembly 600, while holding the second motor mechanism 372 relatively fixed in space. This linear repositioning action of the second extendable element 372 invokes first-phase movement (angular rotation over a first range of degrees) at the second motor tube bracket 470 about the rotational interface with the second motor mounting plate 472 about pivot 473. This first-phase movement of the second motor tube bracket 470 pulls the footrest drive control link 580 rearward and downward a particular distance, which causes the seat-mounting plate 400 to translate over the base plate 410 in a downward and rearward manner (via the pivots 417 and 442).

As discussed above, the seat-mounting plate 400 is pivotably coupled to the rear lift link 460 at the pivot 417. The rearward traversal of the seat-mounting plate 400 acts through the pivot 417 causing counterclockwise rotation (from the perspective as shown in FIG. 5) of the rear lift link 460 about pivot 464. This counterclockwise rotation moves the seat-mounting plate 400 downward and rearward with respect to the lift-base assembly 600. Movement of the seat-mounting plate 400 in this rearward and downward direction pulls the back-mounting link 510, along with the backrest, downward at the pivot 405 and causes the back-mounting link 510 to rotate forward about the pivot 511. At this point, as shown in FIG. 10, the seat-mounting plate 400 is allowed to translate rearward and downward over the base plate 410 until a mid-portion of seat mounting plate 400 comes into contact with a stopping element 460A attached at a mid-portion of the rear lift link 460.

In addition, the counterclockwise rotation of the rear lift link 460 about the pivot 464, which is triggered by the rearward movement of the seat-mounting plate 400, pushes the connector link 450 forward with respect to the base plate 410. This forward push on the connector link 450 moves the sequence element 420 (attached to the connector link 450) in front of a swing path of the contact edge 554 of the sequence cam 550, thereby allowing the sequence cam 550 to rotate downward when adjusting the seating unit to the closed position. Further, the forward push on the connector link 450 applies a directional force to the pivot 443 of the front lift link 440, which transmits the directional force through the front lift link 440 onto the pivot 441 (coupling the front lift link 440 to the front pivot link 430). The directional force transmitted to the front pivot link 430 acts to lower the forward portion 401 of the seat-mounting plate 400 via clockwise rotation of the front lift link 440 at the pivot 442. In this way, this clockwise rotation of the front lift link 440 about the pivot 442 pulls the forward portion 401 of the seat-mounting plate 400 downward and rearward in tandem with the rearward portion 402 of the seat-mounting plate. As a result, the seat-mounting plate 400 is evenly lowered and slightly translated rearward such that the seat carried by seat-mounting plate 400 remains in a consistent angle of inclination during adjustment between the reclined position and the extended position.

Eventually, the rotation of the second motor tube 375 and, consequently, the second motor tube bracket 470 is ceased upon the second linear actuator 390 reaching the end of the first travel section 331. At this point, adjustment from the reclined position to the extended position is substantially complete. Adjustment from the extended position to the reclined position operates substantially similar, but in reverse, to the steps described above.

The operation of the footrest assembly 200 will now be discussed with reference to FIGS. 9 and 10. As discussed above, when desiring to move from the extended position (FIG. 10) to the closed position (FIG. 9), the occupant may invoke an actuation at the hand-operated controller that sends the control signal with instructions to the second linear actuator 390 of the second motor assembly 370 to carry out a stroke in the second phase. That is, with reference to FIG. 9, the second linear actuator 390 slides the second extendable element 371 rearward with respect to the lift-base assembly 600 (over the second travel section 332), while holding the second motor mechanism 372 relatively fixed in space. This sliding action of the second extendable element 371 generates a second rotational movement (angular rotation over a second range of degrees) of second motor tube bracket 470 in a counterclockwise direction about a pivotal interface 473 with the second motor mounting plate 472. This second-phase movement of the second motor tube bracket 470 pulls the footrest drive control link 580 rearward and downward a particular distance, which attempts to cause the seat-mounting plate 400 to translate over the base plate 410 in a downward and rearward manner (via the pivots 417 and 442). However, as described above the seat-mounting plate 400 is blocked from translating rearward over the base plate 410 because the mid-portion of the seat mounting plate 400 encounters the stopping element 460A attached at a mid-portion of the rear lift link 460.

Yet, the second-phase movement (angular rotation over a second range of degrees) of the second motor tube bracket 470 serves to translate the footrest drive control link 580 rearward and downward, thereby generating a rearward directional force at the pivot 593. This rearward translation of the footrest drive control link 580 via pivot 593 pulls the front ottoman link 120 downward about pivot 121 and rotates the rear ottoman link 110 downward about pivot 115 via the upper ottoman link 140. The downward rotation of the rear ottoman link 110 about pivot 115 produces a downward and rearward force on the cam control link 540 via pivot 114. This downward and rearward force causes the cam control link 540 to shift rearward and downward through pivot 552; thus, causing the sequence cam 550 to rotate counterclockwise about pivot 551 (rotatably coupling the sequence cam 550 to the seat mounting plate 400).

Further, the downward rotation of the front ottoman link 120 about pivot 121 produces a downward and rearward force on the upper ottoman link 140 and, indirectly, the other links 110, 127, 128, 130, and 170, which pulls them toward the lift-base assembly 600. In one instance, this downward and rearward force on the front ottoman link 120 removes the front ottoman link 120 from contact with a stop element that serves to limit the extension of the footrest assembly 200. As such, the foot-support ottomans are retracted to a position substantially below a front edge of the seat.

Also, similar to the adjustment in the first phase, the second-phase movement of the second linear actuator 390 generates clockwise rotation of the second motor tube bracket. Eventually, the clockwise rotation of the second motor tube bracket 470 is ceased upon the second linear actuator 390 reaching the end of the second travel section 332. At this point, adjustment from the extended position to the closed position is substantially complete.

In a manner that is reverse to the steps discussed above, with reference to operation of the footrest assembly 200 from the closed position to the extended position, the automated force of the second linear actuator 390 upon the second motor tube in the second phase of the linear-actuator stroke forces the footrest drive control link 580 forward and upward, which, in turn, rotates the front ottoman link 120 about the pivot 121. This rotation acts to extend the footrest assembly 200 and causes the other links 110, 127, 128, 130, 140, and 170 to move upwardly and/or rotate in a clockwise direction, with reference to FIG. 10. Also, the footrest bracket 170 is raised and rotated in a clockwise fashion such that the ottoman(s) 45 (see FIGS. 1-3) are adjusted from a collapsed, generally vertical orientation to an extended, generally horizontal orientation. Extension of the footrest assembly is restrained upon the front ottoman link 120 coming into contact with a stop element or another detention feature.

It should be understood that the construction of the linkage mechanism 100 lends itself to enable the various links and brackets to be easily assembled and disassembled from the remaining components of the seating unit. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seating unit having a chassis, a seat, a backrest, and at least one foot-support ottoman, the seating unit being adapted to move between a closed, an extended, a reclined, and a seat-lift position, the seating unit comprising:

a lift-base assembly that rests on an underlying surface;

a pair of base plates in substantially parallel-spaced relation;

a pair of lift assemblies, wherein each of the lift assemblies is attached to a respective base plate and raises and lowers the respective base plate directly above the lift-base assembly;

a pair of seat-mounting plates in substantially parallel-spaced relation, wherein the seat-mounting plates suspend the seat over the lift assemblies;

a pair of generally mirror-image linkage mechanisms each moveably interconnecting each of the base plates to a respective seat-mounting plate, wherein each of the linkage mechanisms comprise:

(a) a footrest assembly that extends and retracts the at least one foot-support ottoman; and (b) a seat-adjustment assembly that reclines and inclines the backrest;

a first linear actuator that provides automated adjustment of the seating unit between the closed position and the seat-lift position, wherein the first linear actuator is configured to move the lift assemblies into and out of the seat-lift position while consistently maintaining the seat-mounting plates inside a footprint of the lift-base assembly; and a second linear actuator that provides automated adjustment of the seating unit between the extended position, the reclined position, and the closed position, wherein in the reclined position, the backrest is reclined and the footrest assembly is extended, wherein in the extended position the backrest is inclined and the footrest assembly is extended, and wherein in the closed position the backrest is inclined and the footrest is retracted.

2. The seating unit of claim 1, wherein the second linear actuator comprises a second extendable element that includes a first travel section and a second travel section, and wherein the first linear actuator comprises a first extendable element that includes a third travel section.

3. The seating unit of claim 2, wherein adjustment of the seating unit is sequenced into a first phase, a second phase, and a third phase that are mutually exclusive in stroke, wherein the first phase moves the seat-adjustment assembly between the reclined position and the extended position when the second extendable element of the second linear actuator is repositioned over the first travel section.

4. The seating unit of claim 3, wherein the second phase moves the footrest assembly between the extended position and the closed position when the second extendable element of the second linear actuator is repositioned over the second travel section.

5. The seating unit of claim 3, wherein the third phase moves the lift assemblies into and out of the seat-lift position when the first extendable element of the first linear actuator is repositioned over the third travel section.

6. The seating unit of claim 3, further comprising a second motor tube that spans between and couples to the linkage mechanisms, wherein the second motor tube has a pair of ends, wherein one of the ends of the second motor tube is rotatably coupled to a respective base plate via a second motor mounting plate, and wherein the second extendable element is directly or indirectly coupled to the second motor tube.

7. The seating unit of claim 6, wherein the seat-adjustment assembly comprises a footrest drive link that includes a front end and a back end, wherein the back end of the footrest drive link is pivotably attached to one of the ends of the second motor tube via one or more intervening links, and wherein the front end of the footrest drive link is pivotably coupled to the footrest assembly.

8. The seating unit of claim 7, wherein the footrest assembly comprises a front ottoman link that is rotatably coupled to a forward portion of a respective seat-mounting plate, and wherein the front end of the footrest drive link is pivotably coupled to the front ottoman link.

9. The seating unit of claim 8, wherein adjusting the seating unit between the reclined position and the extended position involves causing the second motor tube to rotate upon repositioning the second extendable element over the first travel section, wherein the rotation of the second motor tube generates a forward or rearward thrust at the front ottoman link via the interaction of the footrest drive link and the second motor tube.

10. The seating unit of claim 8, wherein adjusting the seating unit between the closed position and the extended position involves causing the second motor tube to rotate upon repositioning the second extendable element over the second travel section, wherein the rotation of the second motor tube generates a forward or rearward thrust at the front ottoman link via the interaction of the footrest drive link and the second motor tube.

11. The seating unit of claim 8, wherein the lift-base assembly comprises:

a front lateral member;

a rear lateral member that is oriented in substantially parallel-spaced relation to the front lateral member;

a left longitudinal member; and a right longitudinal member that is oriented in substantially parallel-spaced relation to the left longitudinal member, wherein the left and right longitudinal members span and couple the front and rear lateral members, and wherein the left and right longitudinal members and the front and rear lateral members represent a perimeter of the footprint of the lift-base assembly.

12. The seating unit of claim 11, wherein the first extendable element is pivotably coupled to a section between a pair of ends of the rear lateral member via a rear motor bracket, and wherein, during the stroke of the first linear actuator within the third phase, a first motor mechanism moves forward and upward with respect to the lift-base assembly while the first extendable element remains generally fixed in space.

13. The seating unit of claim 12, wherein each of the lift assemblies comprise:

a riser connector plate that is fixedly attached to a respective longitudinal member of the lift-base assembly, the riser connector plate having an upper end and a lower end;

an upper lift link that is pivotably coupled at one end to a respective base plate and is rotatably coupled at another end to the upper end of the riser connector plate; and a lower lift link that is pivotably coupled at one end to a respective base plate and is rotatably coupled at another end to the lower end of the riser connector plate.

14. A pair of generally mirror-image linkage mechanisms adapted to move a seating unit between a reclined, an extended, a closed, and a seat-lift position, the seating unit having a pair of lift assemblies that are adapted to adjust the seating unit into and out of the seat-lift position, a seat that is angularly biased via the lift assemblies, and a backrest that is angularly adjustable with respect to the seat, each of the linkage mechanisms comprising:

a seat-mounting plate that includes a forward portion and a rearward portion, wherein the seat is fixedly mounted to the seat-mounting plate;

a seat-adjustment assembly that reclines and inclines the backrest;

a footrest assembly that extends and retracts at least one foot-support ottoman;

a cam control link that includes a front end and a rear end, wherein the front end of the cam control link is pivotably coupled with the footrest assembly;

a sequence cam that includes a contact edge and is rotatably coupled to the seat-mounting plate, wherein the rear end of the cam control link is pivotably coupled to the sequence cam;

a first linear actuator that provides automated adjustment of the seating unit between the closed position and the seat-lift position, wherein the first-linear-actuator adjustment is sequenced into a third phase, wherein the third phase moves the pair of lift assemblies into and out of the seat-lift position; and a second linear actuator that provides automated adjustment of the seating unit between the extended position, the reclined position, and the closed position, wherein the second-linear-actuator adjustment involves a first phase and a second phase, wherein the first, second, and third phases are sequenced such that the first, second, and third phases are mutually exclusive in stroke, wherein the first phase moves the seat-adjustment assembly between the reclined position and the extended position.

15. The linkage mechanisms of claim 14, further comprising:

an actuator control adapted to control both the first linear actuator and the second linear actuator, the actuator control having two buttons that operably control both the first linear actuator and the second linear actuator.

16. The linkage mechanisms of claim 15, further comprising a base plate;

a second motor tube; and a second motor mounting plate having a first end and a second end, wherein the first end of the second motor mounting plate is rotatably coupled to the base plate.

17. The linkage mechanisms of claim 16, wherein the seat-adjustment assembly comprises:

a footrest drive link that includes a front end and a back end, wherein the second end of a second motor tube bracket is rotatably coupled to the back end of the footrest drive link via one or more intervening links, and wherein the front end of the footrest drive link is rotatably coupled to the footrest assembly.

18. The linkage mechanisms of claim 17, wherein the second linear actuator comprises:

a second motor mechanism attached to a front motor tube, wherein the front motor tube is fixedly attached directly or indirectly to the forward portion of the base plate, and wherein the front motor tube extends substantially perpendicular to the base plate in an inward manner to reside below the seat; and a second extendable element that linearly extends and retracts with respect to the second motor mechanism during the first phase and the second phase, wherein the second extendable element is pivotably coupled to the second motor tube.

19. The linkage mechanism of claim 18, wherein first-phase adjustment of the second linear actuator causes the second motor mounting plate to bias within a first range of degrees via the second motor tube, wherein the second-phase adjustment of the second linear actuator causes the second motor mounting plate to angularly bias within a second range of degrees that does not overlap the first range of degrees, wherein the bias of the second motor mounting plate within the first range of degrees generates movement of the seat-adjustment assembly while maintaining the at least one foot-support ottoman in an extended orientation, and wherein the angular bias within the second range of degrees generates movement of the footrest assembly while maintaining the backrest in an inclined orientation.

20. A seating unit, comprising:

a lift-base assembly that contacts an underlying surface;

a pair of base plates in substantially parallel-spaced relation;

a pair of lift assemblies, wherein each of the lift assemblies is attached to a respective base plate and moveably supports the respective base plate with respect to the lift-base assembly, wherein the lift assemblies are adapted to adjust the seating unit into and out of a seat-lift position;

a pair of seat-mounting plates in substantially parallel-spaced relation, wherein each of the seat-mounting plates is consistently disposed within a footprint of the lift-base assembly throughout movement of the seating unit; and a pair of generally mirror-image linkage mechanisms each moveably interconnecting each of the seat-mounting plates to a respective base plate, and adapted to move the seating unit between a closed position, an extended position, and a reclined position, wherein each of the linkage mechanisms comprise:

(a) a back-mounting link rotatably coupled to a respective seat-mounting plate and configured to support a backrest of the seating unit;

(b) a rear lift link rotatably coupled to a respective seat-mounting plate and pivotably coupled to a rearward portion of a respective base plate;

(c) a back-support link pivotably coupled to the back-mounting link and to the rearward portion of a respective base plate;

(d) a sequencing cam rotatably coupled to a mid-portion of a respective seat-mounting assembly;

(e) a connector link that includes a front end and a rear end, wherein the rear end of the connector link is pivotably coupled with the sequencing cam; and (f) a front lift link that is rotatably coupled to a respective seat-mounting plate, wherein the front end of the connector link is pivotably coupled to the front lift link.

* * * * *